United States Patent [19]

Bissonette

[11] 4,146,395

[45] Mar. 27, 1979

[54] REVERSAL IMAGING PROCESS INCLUDING REDOX AMPLIFICATION

[75] Inventor: Vernon L. Bissonette, Brockport, N.Y.

[73] Assignee: Eastman Kodak Company, Rochester, N.Y.

[21] Appl. No.: 841,867

[22] Filed: Oct. 13, 1977

Related U.S. Application Data

[60] Division of Ser. No. 730,912, Oct. 8, 1976, Pat. No. 4,089,685, which is a continuation-in-part of Ser. No. 628,880, Nov. 5, 1975, abandoned.

[51] Int. Cl.[2] ..... G03C 7/16; G03C 5/50; G03C 5/26; G03C 5/54

[52] U.S. Cl. ..... 96/22; 96/59; 96/50 R; 96/29 D

[58] Field of Search ..... 96/22, 59, 50 R, 29 D

[56] References Cited

U.S. PATENT DOCUMENTS

| | | | |
|---|---|---|---|
| 3,658,525 | 4/1972 | Bent et al. | 96/22 |
| 3,674,490 | 7/1972 | Matejec | 96/48 R |
| 3,694,207 | 9/1972 | Matejec et al. | 96/48 R |
| 3,776,730 | 12/1973 | Matejec et al. | 96/55 |
| 3,862,842 | 1/1975 | Bissonette | 96/22 |
| 3,953,211 | 4/1976 | Imai et al. | 96/29 D |

OTHER PUBLICATIONS

Katz & Fogel, "Photographic Analysis", Morgan & Morgan, N.Y., N.Y. © 1971, p. 102.

*Primary Examiner*—J. Travis Brown
*Assistant Examiner*—L. Falasco
*Attorney, Agent, or Firm*—Carl O. Thomas

[57] ABSTRACT

A process is disclosed of forming a reversal dye image. This is accomplished by developing an imagewise exposed photographic element with a black-and-white developer and poisoning the developed silver as a redox amplification catalyst for a peroxide oxidizing agent. The undeveloped silver is then rendered developable to form a silver catalyst image pattern. This latter silver image pattern is then used to catalyze the redox reaction of a peroxide oxidizing agent and a dye-image-generating reducing agent, such as a color-developing agent, or a redox dye-releaser.

20 Claims, 4 Drawing Figures

REVERSAL IMAGING PROCESS INCLUDING REDOX AMPLIFICATION

CROSS-REFERENCE TO RELATED APPLICATIONS

This application is a division of my application Ser. No. 730,912, filed Oct. 8, 1976, now U.S. Pat. No. 4,089,685, which is a continuation-in-part of my application Ser. No. 628,880, filed Nov. 5, 1975 now abandoned.

FIELD OF THE INVENTION

The present invention is directed to a novel process of producing photographic dye images. More specifically, the present invention is directed to a process of forming reversal dye images. Still more specifically, the present invention is directed to a process of forming reversal dye images through the use of a peroxide oxidizing agent in a redox amplification reaction.

BACKGROUND OF THE INVENTION

The formation of reversal dye images in photographic elements is generally old and well known in the photographic arts. In a typical approach a photographic element capable of forming a multicolor image is imagewise exposed and developed in a black-and-white photographic developer composition. The undeveloped silver halide is next rendered developable by uniform exposure or by nucleation. The remaining silver halide is then developed using a color developing agent so that a positive dye image is formed. Reversal processing has proven quite attractive, since it offers a convenient approach for obtaining a positive dye image using a negative-working silver halide emulsion without the necessity of first producing a negative dye image and then reexposing a second photographic element through the negative dye image. Reversal processing to form positive dye images is widely employed in producing color photographic transparencies.

In my U.S. Pat. No. 3,862,842, issued Jan. 28, 1975, I disclose a process of forming a reversal dye image using a redox amplification process in which a cobalt(III) complex is employed as an oxidizing agent. Example 10 illustrates that in attempting to undertake reversal processing using a cobalt(III) complex as an oxidizing agent both the black-and-white and the color developed silver acts as a redox amplification catalyst. Unless a step is interposed in the process to remove the black-and-white developed silver, no reversal dye image can be obtained. Specifically, in Example 10 a control strip (1) is given a conventional reversal processing. A strip (2) is identically processed, except that 1.6 grams/liter of cobalt hexammine chloride are added to the color developer solution. The result is that instead of forming a dye image a uniform high density of dye is formed in each of the red, green and blue sensitive layers of the photographic element being processed—that is, maximum and minimum density measurements were identical. A third strip (3) was processed identically as strip (2), but with the variation that after a silver image had been formed through initial exposure and black-and-white development, the silver image was removed by bleaching. In strip (3) a reversal dye image was obtained having an enhanced maximum dye density in each of the red, green and blue sensitive layers.

In my U.S. Pat. No. 3,862,842 I refer to column 9, lines 35 through 39, to the photolytic formation of a development inhibitor, such as phenylmercaptotetrazole. In my pending U.S. patent application Ser. No. 420,193, filed Nov. 28, 1973, this same statement appears with the intended teaching being illustrated by the examles. In Example 1 a photographic element is formed containing palladium nuclei and a color coupler in a first layer coated on a photographic support. This layer is overcoated with an oxidized color developing agent scavenging layer which is in turn overcoated with a negative-working silver bromoiodide emulsion layer containing a development inhibitor releasing (DIR) coupler capable of liberating phenylmercaptotetrazole upon silver development. The photographic element is used to form a positive dye transfer image by imagewise exposing the emulsion layer and then processing by bringing a receiver bearing a mordant and soaked with a color developer composition containing cobalt hexammine chloride and a silver solvent into contact with the exposed emulsion layer. As development occurs in the emulsion layer, phenylmercaptotetrazole is released from the DIR coupler and migrates to the first layer containing the palladium nuclei. This results in catalyst poisoning so that a redox amplification occurs in the first layer involving the cobalt hexammine as an oxidant and the color developing agent as a reducing agent only in the unexposed areas of the element. The oxidized color developing agent formed by the redox reaction in turn reacts with the color coupler contained in the first layer to form a mobile dye which diffuses to the receiver and forms a positive dye image in the receiver.

It is known in the art that in the presence of a catalyst a peroxide oxidizing agent can enter into a redox amplification reaction with a color developing agent to produce a dye image in a photographic element. The formation of positive dye images using peroxide oxidizing agents is generally known in the art. In Matejec et al U.S. Pat. No. 3,694,207, issued Sept. 26, 1972, positive dye images are formed by providing a uniform coating of a peroxide redox catalyst on a photographic support. Upon imagewise exposure the redox catalyst is destroyed in light-struck areas. Using a peroxy redox amplification reaction a positive dye image is formed in the areas where the catalyst remains. In Matejec et al U.S. Pat. No. 3,776,730, issued Dec. 4, 1973, a positive dye image is formed in a peroxide redox amplification process by imagewise exposing a silver halide photographic element containing a negative-working emulsion. The emulsion is developed using a black-and-white developer to form a negative silver image. Upon treatment with peroxide, the peroxide is quickly decomposed in the areas containing the silver image, thereby leaving behind a peroxide distribution corresponding to the unexposed areas of the photographic element. By incorporating in the photographic element substances which will decompose the peroxide at a slower rate than the silver image, the residual peroxide in the unexposed areas can be slowly decomposed under conditions which promote the formation of a positive image. Either a dye or a vesicular positive image can be formed.

It is known in the art that heterogeneous catalyst surfaces for peroxide redox amplification reactions can be poisoned by adsorbed materials. This is pointed out in *Research Disclosure,* Vol. 116, Item No. 11660, titled "Image Amplification Systems," published December, 1973. A number of materials are disclosed which tend to become adsorbed to the surface of catalytic noble metal nuclei and thereby to interfere with peroxide oxidizing agent redox reactions with color-developing agents.

These include adsorbed stabilizers, antifoggants and spectral sensitizing dyes. Azoles and thiazoles which are free from mercaptan and ionic iodide moieties are taught to be useful without fouling catalytic surfaces. Mercaptotetrazoles, -oxazoles, and -imidazoles are taught to be avoided. Since peroxide-containing amplifier solutions may be poisoned by bromide ions or antifoggants carried over from conventional development solutions, it is taught to limit developing solution potassium bromide or antifoggant concentrations to no greater than 1 gram per liter. In Example 5 it is shown that when 2 grams of potassium bromide was incorporated in a liter of the color developer composition, no amplification was obtained using a peroxide oxidizing agent; when the developer contained 200 mg per liter of 5-methyl benzotriazole both antifoggant and amplification effects were satisfactory; when the developer contained 200 mg per liter of 3-methyl-1,3-benzothiazolium iodide, no amplification was obtained; and when the developer contained 200 mg per liter of decamethylene bisbenzothiazolium bromide, both antifoggant and amplification effects were satisfactory. This is corroborated by Matejec U.S. Pat. No. 3,674,490, issued July 4, 1972, which refers to a silver catalyst surface for a peroxide redox amplification reaction being "purified" by displacement of adsorbed, inactivating substances (e.g., emulsion stabilizers), to increase its catalytic activity.

SUMMARY OF THE INVENTION

In one aspect, my invention is directed to a method of forming a reversal dye image. I can accomplish this by developing, to produce a silver image, an imagewise exposed photographic element comprised of a support and at least one radiation-sensitive silver halide layer containing a developable latent image therein. I poison the silver image to inhibit its ability to catalyze a redox reaction between a peroxide oxidizing agent and a dye-image-generating reducing agent capable of providing a dye-image-generating reaction product upon oxidation, wherein the peroxide oxidizing agent and the reducing agent ae chosen so that they are essentially inert to oxidation-reduction in the absence of a catalyst. I then render the undeveloped silver halide remaining in the radiation-sensitive layer developable and develop the remaining silver halide to form a reversal silver image. I catalyze with the reversal silver image a redox reaction between the peroxide oxidizing agent and the reducing agent to permit a reversal dye image to be formed.

My invention offers a simple and convenient approach for achieving the advantages of redox amplification of dye images in reversal processing. It is well appreciated in the art that the maximum density of dye images can be greatly enhanced by using redox amplification processing. However, attempts to apply redox amplification to reversal processing have resulted in the requirement of additional process steps and/or in the use of photographic elements which have been significantly structurally modified to permit redox amplification to be practiced during reversal processing.

I have discovered that it is possible to achieve redox amplification of dye images in reversal processing without resorting to structural modification of conventional silver halide photographic elements normally employed in reversal processing. I have further discovered quite unexpectedly that by employing a peroxide oxidizing agent during the dye-image forming step of a conventional reversal process, this conventional process can be transformed into a reversal process obtaining the advantages of peroxide redox amplification of dye images. This is quite unexpected, since approaches heretofore taught in the art for obtaining reversal dye images using peroxide oxidizing agents have departed very significantly from conventional reversal processing in either element structure or manipulative processing. My invention offers the further advantage in one preferred form of permitting the selective generation of a redox amplification catalyst for use with a peroxide oxidizing agent concurrently with performing conventional reversal processing steps. That is, a redox amplification catalyst is selectively generated without adding to the manipulative complexity of reversal processing in terms of the number of processing baths employed or their sequence of use.

While I prefer to perform the steps of my redox amplification process without adding to the number of processing baths employed in conventional reversal processing, I recognize that my process is susceptible to modification. Where advantageous I can separate the steps of catalytic silver image generation and redox amplification. I can also separate the steps of initial silver image development and catalyst poisoning, if desired.

It is a specific feature of my invention that I have found ways of generating and controlling halide ions for use as catalyst poisons in applying peroxide redox amplification to reversal processing. It is a specific advantageous feature of my invention that I can selectively poison the black-and-white developed silver of a reversal processed photographic element using halide ions, particularly, iodide ions. I have further discovered that silver haloiodides, which release iodide ions during color development, can be employed effectively in my process. It is an additional advantageous feature of my process that I can use small amounts of iodide ions to poison black-and-white developed silver as a redox catalyst and that I can thereafter perform intermediate processing steps, e.g., immersion in stop and/or wash baths, without losing the desired selective poisoning of the black-and-white developed silver.

In one illustrative, preferred mode of practicing my invention a conventional silver halide emulsion photographic element of a type used in producing multicolor images is employed in processing. In a preferred form the photographic element is comprised of a conventional photographic support having coated thereon at least three superimposed negative-working silver halide emulsion layers formed and positioned to each record a separate one of the blue, green and red thirds of the visible spectrum. The blue recording emusion layer additionally contains a yellow dye-forming incorporated color coupler; the green recording emulsion layer contains a magenta dye-forming incorporated color coupler; and the red recording emulsion layer contains a cyan dye-forming incorporated color coupler.

The photographic element is imagewise panchromatically exposed in a conventional manner to form a latent image in each of the emulsion layers. To develop the latent image in each emulsion layer the photographic element is immersed in a conventional black-and-white silver halide developer composition, thereby producing a silver image in the layers which is a negative of the original image. Sufficient poison, such as chloride, bromide or, preferably, iodide ions, is incorporated in the developer composition so that the silver image is poisoned as a redox amplification catalyst concurrently with its formation. Alternatively, where the silver halide is a silver haloiodide, sufficient iodide ion can be released upon black-and-white development that no separate source of iodide ion need be provided.

The silver halide remaining in the photograhic element which has not been expended in black-and-white development is next rendered developable. This can be accomplished by uniformly panchromatically exposing the photographic element or by bringing the photographic element into contact with a nucleating agent. Where the latter approach is relied upon, rendering the residual silver halide developable can be easily combined with the next major processing step, which is immersing the photographic element in a color developer composition. In a simple approach to practicing my process the color developer composition contains not only a nucleating agent, but a color-developing agent and a peroxide oxidizing agent as well. The nucleating agent first renders the residual silver halide developable. The color developing agent then reduces the developable silver halide to silver while being itself oxidized. The oxidized developing agent in each emulsion layer reacts with the color coupler incorporated therein to form a dye image within the photographic element.

The peroxide oxidizing agent reacts with residual color developing agent to form additional oxidized developing agent. This latter reaction is catalyzed by the silver produced by color development and is not catalyzed by the silver produced by black-and-white development, since the black-and-white developed silver has been poisoned as a catalyst concurrently with its formation. The additional oxidized developing agent produced by the peroxide oxidizing agent reacts in each layer with residual incorporated color coupler to produce additional image dye. In this way, the original positive dye image produced by the direct reduction of the silver halide by the color developing agent is amplified. The effect can be used to accelerate development to a given density level, to achieve a higher maximum density level than would otherwise be possible and/or to reduce the amount of the silver halide originally required within the photographic element.

In another illustrative, preferred mode of practicing my invention a conventional silver halide emulsion photographic element of a type used in producing multicolor images is employed in processing which differs from the incorporated color coupler element described above by having a redox dye-releasing compound in place of the color coupler in each of the emulsion layers or in a separate layer adjacent thereto, such that a yellow dye can be released from the blue recording emulsion layer or a layer adjacent thereto; a magenta dye can be released from the green recording emulsion layer or a layer adjacent thereto and a cyan dye can be released from the red recording emulsion layer or a layer adjacent thereto. Processing can be undertaken identically as described above for the incorporated color coupler photographic element, except that in this instance in place of the color-developing agent it is merely necessary to employ a conventional cross-oxidizing developing agent. The cross-oxidizing developing agent reacts with the peroxide oxidizing agent on the unpoisoned, catalytic silver image surface to form oxidized developing agent. This oxidized developing agent then cross-oxidizes the redox dye-releaser, thereby regenerating the developing agent and causing an image dye to be released directly or upon hydrolysis. The released dye is then preferably transferred to a conventional receiver to form a transferred dye image. Additionally or alternatively a useful retained dye image can be formed. In this instance the unreacted redox dye-releaser forms the retained dye image. It should be noted that while the retained and transferred dye images are complementary they are both reversals of the retained and transferred dye images, respectively, which would be produced by using the first developed silver image as a redox catalyst.

Although my invention has been summarized above with reference to specific preferred modes of practicing my process, one or more advantages of my process can also be obtained in various alternative modes. The scope and advantages of my process will become more fully apparent by reference to the following detailed description considered in conjunction with the drawings, in which FIG. 1 is a plot of ten characteristic curves (or H and D curves) wherein density is plotted against exposure, measured in steps, Curves 1 and 2 are silver image density curves; Curves 3 and 4 are cyan dye and silver density curves obtained through conventional reversal processing; Curves 5, 7 and 9 are cyan dye and silver density curves for differing development times provided for control purposes to show the result when conventional reversal processing is combined with redox amplification processing without practicing my invention; and Curves 6, 8 and 10 correspond to Curves 5, 7 and 9, respectively, but illustrate the practice of my process;

FIG. 2 is a plot of two characteristic curves, wherein Curve 11 is a characteristic curve obtained by conventional reversal processing and Curve 12 is a corresponding characteristic curve obtained through the practice of my process; and FIG. 3 is a plot of dye image density curves for the blue-sensitive, green-sensitive and red-sensitive layers of two multicolor reversal processed photographic element samples wherein Curves B', G' and R' illustrate conventional reversal processing and Curves B, G and R represent the corresponding curves obtained in the practice of my process.

FIG. 4 is a plot of eight dye image density curves, wherein Curves 13 through 16 are characteristic curves obtained for progressively lengthened second development times in the absence of a peroxide oxidizing agent and Curves 17 through 20 are characteristic curves obtained for progressively lengthened second development and amplification times.

DETAILED DESCRIPTION OF MY INVENTION

Figure 1:
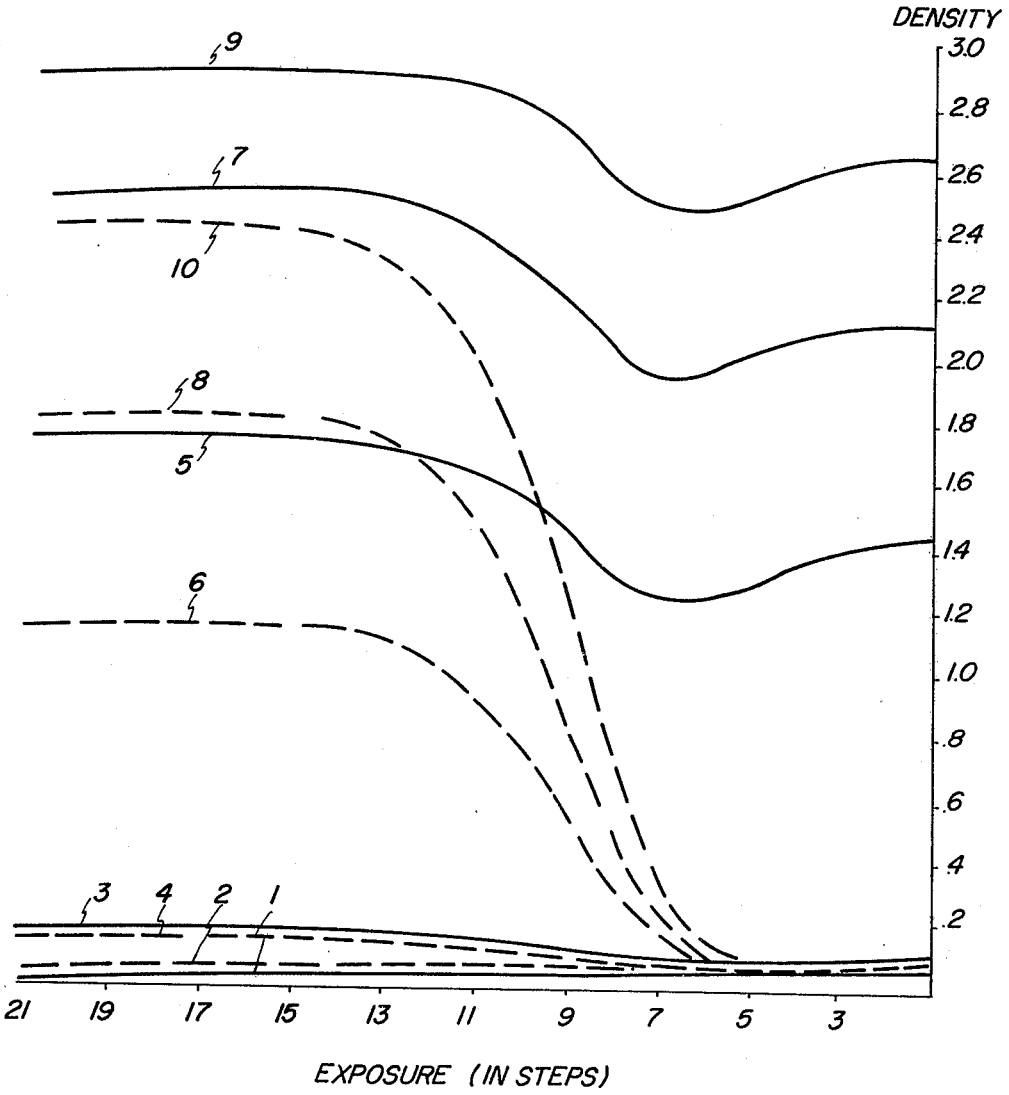

While subheadings are provided for convenience, to appreciate fully the elements of my invention it is intended that my disclosure be read and interpreted as a whole.

The Photographic Element

Any conventional photographic element containing at least one radiation-sensitive silver halide can be employed in the practice of my invention. In a simple form, the photographic element to be processed can be comprised of a conventional photographic support, such as disclosed in *Product Licensing Index,* Vol. 92, December 1971, publication 9232, paragraph X, bearing a single radiation-sensitive silver halid emulsion layer which is either positive-working or, preferably, negative-working. I specifically contemplate the processing of photographic elements containing at least one photographic silver halide layer which upon imagewise exposure to actinic radiation (e.g., ultraviolet, visible, infrared, gamma or X-ray electromagnetic radiation, electron-beam radiation, neutron radiation, etc.) is capable of forming a developable latent image. I contemplate using silver halides, such as silver chloride, silver bromide and silver chlorobromide in the practice of my process in combination with externally supplied silver catalyst poisons. I can also use the silver haloiodides conventionally employed in reversal processing—i.e., those having an iodide content up to about 10 mole percent based on total halide—such as silver bromoiodide, silver chloroiodide and/or silver chlorobromoiodide. These silver haloiodides will release iodide during development which can be used as a silver catalyst poison. The silver halide emulsions employed to form useful emulsion layers include those disclosed in *Product Licensing Index,* publication 9232, cited above, paragraph I, which reads as follows:

> Silver halide emulsions can comprise, for example, silver chloride, silver bromide, silver bromoiodide, silver chlorobromide, silver chloroiodide, silver chlorobromoiodide crystals or mixtures thereof. The emulsions can be coarse or fine grain emulsions and can be prepared by a variety of techniques, eg, single jet emulsions such as those described in Trivelli and Smith *The Photographic Journal,* Vol. LXXIX, May, 1939 (pp 330–338), double jet emulsions such as Lippmann emulsions, ammoniacal emulsions, thiocyanate or thioether ripened emulsions such as those described in Nietz et al U.S. Pat. No. 2,222,264 issued Nov. 19, 1940; Illingsworth U.S. Pat. No. 3,320,069 issued May 16, 1967 and McBride U.S. Pat. No. 3,271,157 issued Sept. 6, 1966. Silver halide emulsions can form latent images predominantly on the surface of the silver halide grains, or predominantly on the interior of the silver halide grains such as those described in Davey et al U.S. Pat. No. 2,592,250 issued May 8, 1952; Porter et al U.S. Pat. No. 3,206,313 issued Sept. 14, 1965; Berriman U.S. Pat. No. 3,367,778 issued Feb. 6, 1968 and Bacon et al U.S. Pat. No. 3,447,927 issued June 3, 1969. If desired, mixture of such surface and internal image-forming emulsions can be made, such being described in Luckey et al U.S. Pat. No. 2,996,382 issued Aug. 15, 1961. Silver halide emulsions can be regular grain emulsions such as the type described in Klein and Moisar, *J. Phot. Sci.,* Vol. 12, No. 5, Sept./Oct., 1964, pp 242–251 and German Patent 2,107,118. Negative type emulsions can be made, as well as direct positive emulsions as described in Leermakers U.S. Pat. No. 2,184,013 issued Dec. 19, 1939; Kendall et al U.S. Pat. No. 2,541,472 issued Feb. 13, 1951; Schouwenaars British Pat. No. 723,019 issued Feb. 2, 1955; Illingsworth et al French Pat. 1,520,821 issued Mar. 4, 1968; Illingsworth U.S. Pat. No. 3,501,307 issued Mar. 17, 1970; Ives U.S. Pat. No. 2,563,785 issued Aug. 7, 1951; Knott et al U.S. Pat. No. 2,456,953 issued Dec. 21, 1948 and Land U.S. Pat. No. 2,861,885 issued Nov. 25, 1958. These emulsions can be prepared, coated and/or modified as disclosed in paragraphs II through IV, VI through VIII, XII, XIV through XVIII and XXI.

While not essential to the practice of my process, where a color-developing agent is employed as a dye-image-generating reducing agent, I prefer to practice my process using photographic elements containing at least one incorporated color coupler. The color couplers employed in combination with the color-developing agents include any compound which reacts (or couples) with the oxidation products of a primary aromatic amino developing agent on photographic development to form an image dye and also any compound which provides useful image dye when reacted with oxidized primary aromatic amino developing agent such as by a coupler-release mechanism. These compounds have been variously termed "color couplers", "photographic color couplers", "dye release couplers", "dye-image-generating couplers", etc., by those skilled in the photographic arts. The photographic color couplers can be incorporated in the processing solutions where amplification occurs, described below, or in the photographic element, e.g., as described and referred to in *Product Licensing Index,* Vol. 92, December 1971, page 110, paragraph XXII. When they are incorporated in the element, they preferably are nondiffusible in a hydrophilic colloid binder (e.g., gelatin) useful for photographic silver halide. The couplers can form diffusible or nondiffusible dyes. Typical preferred color couplers include phenolic, 5-pyrazolone and open-chain ketomethylene couplers. Specific cyan, magenta and yellow color couplers which can be employed in the practice of this invention are described by Graham et al in U.S. Pat. No. 3,046,129 issued Jan. 24, 1962, column 15, line 45, through column 18, line 51, which disclosure is incorporated herein by reference. Such color couplers can be dispersed in any convenient manner, such as by using the solvents and the techniques described in U.S. Pat. Nos. 2,322,027 by Jelley et al issued June 15, 1943, or 2,801,171 by Fierke et al issued July 30, 1957. When coupler solvents are employed, the most useful weight ratios of color coupler to coupler solvent range from about 1:3 to 1:0.1. The useful couplers include Fischer-type incorporated couplers such as those described by Fischer in U.S. Pat. No. 1,055,155 issued Mar. 4, 1913, and particularly nondiffusible Fischer-type couplers containing branched carbon chains, e.g., those referred to in Willems et al U.S. Pat. No. 2,186,849. Particularly useful in the practice of this invention are the nondiffusible color couplers which form nondiffusible dyes.

In certain preferred embodiments, the couplers incorporated in the photographic elements to be processed are water-insoluble color couplers which are incorporated in a coupler solvent which is preferably a moderately polar solvent. Typical useful solvents include tri-o-cresyl phosphate, di-n-butyl phthalate, diethyl lauramide, 2,4-di-tert-amylphenol, liquid dye stabilizers as described in an article entitled "Improved Photographic Dye Image Stabilizer-Solvent", *Product Licensing Index,* Vol. 82, pp. 26–29, March, 1971, and the like.

In certain highly preferred embodiments, the couplers are incorporated in the photographic elements by dispersing them in a water-miscible, low-boiling solvent having a boiling point of less than 175° C. and preferably less than 125° C., such as, for example, the esters formed by aliphatic alcohols and acetic or propionic acids, i.e., ethyl acetate, etc. Typical methods for incorporating the couplers in photographic elements by this technique and the appropriate solvents are disclosed in U.S. Pat. No. 2,949,360, column 2, by Julien; 2,801,170 by Vittum et al; and 2,801,171 by Fierke et al.

Color couplers can also be incorporated into the photograpic elements that are useful in the practice of my invention by blending them into the photographic emulsions in the form of latexes, called "coupler-loaded" latexes. Coupler-loaded latexes are polymeric latexes into the particles of which has been blended the coupler(s). Coupler-loaded latexes can be prepared in accordance with the process of Chen, which is described in U.S. Patent Application Ser. No. 575,689, filed May 8, 1975, the disclosure of which is incorporated by reference into the present application. Briefly, this process involves (1) the dissolution of the coupler into a water-miscible organic solvent, (2) blending into the resulting solution a selected latex, and (3) optionally removing the organic solvent, for example, by evaporation thereof.

In one specific preferred form, the photographic elements to be employed in the practice of my process can comprise a support having thereon at least one image dye-providing layer unit containing a light-sensitive silver halide having associated therewith a stoichiometric excess of coupler of at least 40% and preferably at least 70%. The equivalency of color couplers is known in the art; for example, a 4-equivalent coupler requires 4 moles of oxidized color developer, which in turn requires (in the absence of redox amplification) development of 4 moles of silver, to produce 1 mole of dye. Thus, for a stoichiometric with silver halide, 1-equivalent weight of this coupler will be 0.25 mole. In accordance with this invention, the color image-providing unit comprises at least a 40% excess of the equivalent weight of image dye-providing color coupler required to react on a stoichiometric basis with the developable silver and preferably a 70% excess of said coupler. In one highly preferred embodiment, at least a 110% excess of the coupler is present in the dye image-providing layers based on silver. The ratio can also be defined as an equivalent excess with a coupler-to-silver ratio of at least 1.4:1, and preferably at least 1.7:1 (i.e., 2:1 being a 100% excess). In certain preferred embodiments, the photographic color couplers are employed in the image dye-providing layer units at a concentration of at least 3 times, such as from 3 to 20 times, the weight of the silver in the silver halide emulsion, and the silver is present in said emulsion layer at up to 30 mg silver/ft$^2$ (325 mg/m$^2$). Weight ratios of coupler-to-silver coverage which are particularly useful are from 4 to 15 parts by weight coupler to 1 part by weight silver. Advantageously, the coupler is present in an amount sufficient to give a maximum dye density in the fully processed element of at least 1.7, preferably at least 2.0, and, in the case of transparent support elements, most preferably at least 3.0. Preferably, the difference between the maximum density and the minimum density in the fully processed element (which can comprise unbleached silver) is at least 0.6 and preferably at least 1.0.

The light-sensitive silver halide layers used in elements processed in accordance with this invention are most preferably at silver coverages of up to about 30 mg silver/ft$^2$ (325 mg/m$^2$), such as from 0.1 to 30 mg/ft$^2$ (1.0–325 mg/m$^2$) and more preferably from about 1 to 25 mg silver/ft$^2$ (10–270 mg/m$^2$). Especially good results are obtained with coverages on the order of from about 2 to 15 mg/ft$^2$ of silver (20–160 mg/m$^2$) for the green- and red-sensitive layers in typical multilayer color films.

It is realized that the density of the dye may vary with the developing agent combind with the respective coupler, and accordingly the quantity of coupler can be adjusted to provide the desired dye density. Preferably, each layer unit contains at least $1 \times 10^{-6}$ moles/dm$^2$ of color coupler when color couplers are employed.

Advantageously, the photographic color couplers utilized are selected so that they will give a good neutral dye image. Preferably, the cyan dye formed has its major visible light absorption between about 600 and 700 nm (that is, in the red third of the visible spectrum), the magenta dye has its major absorption between about 500 and 600 nm (that is, in the green third of the visible spectrum), and the yellow dye has its major absorption between about 400 and 500 nm (that is, in the blue third of the visible spectrum). Particularly useful elements comprise a support having coated thereon red-, green- and blue-sensitive silver halide emulsion layers containing, respectively, cyan, magenta and yellow dye-forming photographic color couplers.

The light-sensitive silver halides are generally coated in the color-providing layer units in the same layer with the photographic color coupler. However, they can be coated in separate adjacent layers as long as the coupler is effectively associated with the respective silver halide emulsion layer to provide for immediate dye-providing reactions to take place before substantial color-developer oxidation reaction products diffuse into adjacent color-providing layer units.

Where an initially immobile dye-image-generating reducing agent is employed, it is initially present within the photographic element. Redox dye-releasers (RDR's) constitute a preferred class of initially immobile dye-image-generating reducing agents. Suitable redox dye-releaser containing photographic elements useful in the practice of my process can be formed by substituting RDR's for the incorporated color couplers in the photographic elements described above. In a multilayer photographic element intended to form a multicolor image one or more RDR's capable of releasing a yellow dye are incorporated in the blue recording emulsion layer or in a separate processing solution permeable layer adjacent thereto at a concentration of from about 0.5 to 8 percent by weight based on the total weight of the emulsion layer. The layer adjacent the emulsion layer is typically a hydrophilic colloid layer, such as a gelatin layer. In a similar manner one or more RDR's are also associated with the green and red recording emulsion layers capable of releasing magenta and cyan dyes, respectively. Single color, single RDR-containing photographic elements are, of course, useful as well as multicolor elements.

Exemplary redox dye-releasers useful in the practice of my process and their synthesis and incorporation into photographic elements are, for example, in Whitmore et al Canadian Patent 602,607 (issued August 2, 1960); Fleckenstein Belgian Pat. No. 788,268 (issued Feb. 28, 1973); Fleckenstein et al published U.S. patent application Ser. No. B351,673 (published January 28, 1975); Gompf U.S. Pat. No. 3,698,897; Becker et al U.S. Pat. No. 3,728,113; Anderson et al U.S. Pat. No. 3,725,062; and U.S. Pat. Nos. 3,443,939; 3,443,940; 3,443,941; 3,390,380 and the like; all of which are here incorporated by reference.

Exemplary of specifically preferred RDR's are those of the sulfonamide type, which may be represented by the following general formula:

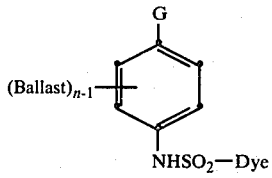

(I)

wherein:

(1) Dye is a dye or dye precursor moiety;

(2) Ballast is an organic ballasting radial of such molecular size and configuration (e.g., simple organic groups or polymeric groups) as to render the compound nondiffusible during development in an alkaline processing composition;

(3) G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when $R_1$ is an alkyl group of a greater than 6 carbon atoms, it can serve as a partial or sole Ballast group); and (4) n is a positive integer of 1 to 2 and is 2 when G is OR or when $R_1$ is hydrogen or an alkyl group of less than 8 carbon atoms.

In addition to Ballast, the benzene nucleus in the aove formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

Exemplary hydroquinone-type RDR's which can be used according to this invention are represented by the following formula:

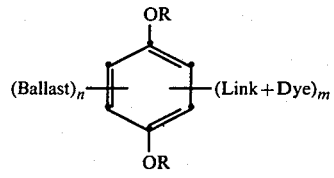

(II)

wherein:

(1) each R represents hydrogen or a hydrolyzable moiety;

(2) Ballast is a photographically inert organic ballasting radical of such molecular size and configuration as to render the alkali-cleavable compound nondiffusible during development in an alkaline processing composition;

(3) Dye is a dye or dye precursor;

(4) Link is a S, O, or $SO_2$ linking group;

(5) n is an integer of 1 to 3; and (6) m is an integer of 1 to 3.

The nature of the ballast group (Ballast) in the formula for the compounds described above is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

As previously mentioned, Dye in the above formula represents a dye or dye precursor moiety. Such moieties are well known to those skilled in the art and include dyes such as azo, azomethine, azopyrazolone, indoaniline, indophenol, anthraquinone, triarylmethane, alizarin, metal complexed dyes, etc., and dye precursors such as a leuco dye, a "shifted" dye which shifts hypsochromically or bathochromically when subjected to a different environment such as a change in pH, reaction with a material to form a complex, etc. Dye could also be a coupler moiety such as a phenol, naphthol, indazolone, open-chain acetanilide, pivalylacetanilide, malonamide, malonanilide, cyanoacetyl, coumarone, pyrazolone, compounds described in U.S. Pat. No. 2,765,142, etc. These compounds may contain a solubilizing group if desired. Examples of such dye groups include the following:

YELLOW DYE GROUPS

YDG-1 4-Hydroxy azophenylphenylene

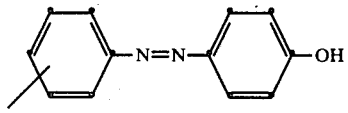

YDG-2 3-Methyl-4-hydroxyazophenylphenylene

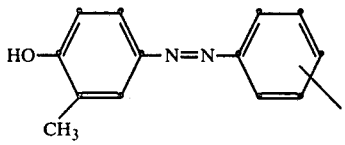

YDG-3

-continued
YELLOW DYE GROUPS
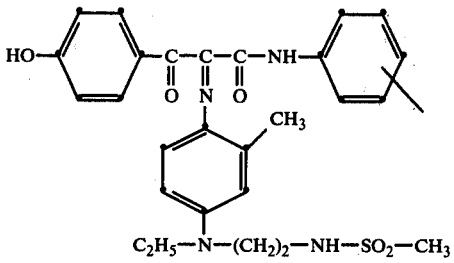
YDG-4 p-Sulfhydrylazophenylphenylene
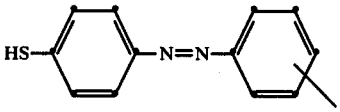
YDG-5
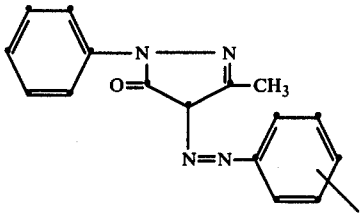
YDG-6
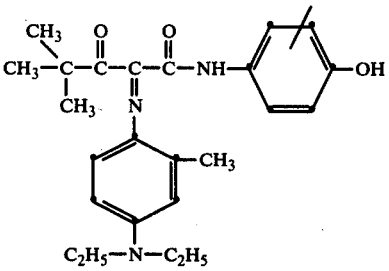
YDG-7
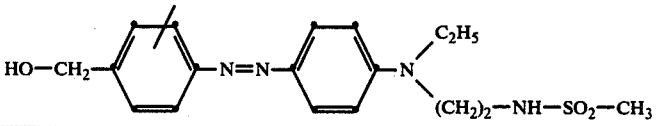
MAGENTA DYE GROUPS
MDG-1
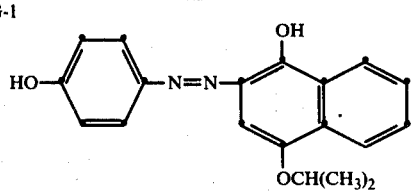
MDG-2
-continued
MAGENTA DYE GROUPS
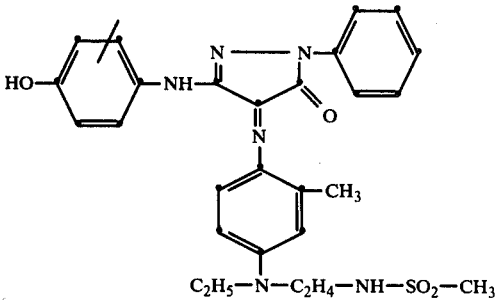

CYAN DYE GROUPS

CDG-1

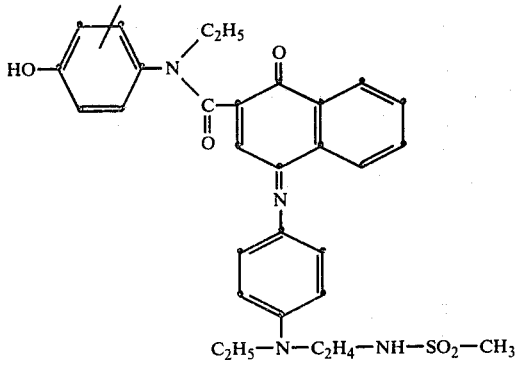

CDG-2

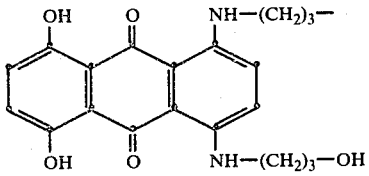

When dye precursor moieties are employed in the RDR's instead of dyes, they are converted to dyes by means well known to those skilled in the art, e.g., oxidation, either in the photosensitive element, in a processing composition or in a dye image-receiving layer to form a visible dye. Such techniques are disclosed, for example, in British Pat. Nos. 1,157,501; 1,157,502; 1,157,503; 1,157,504; 1,157,506; 1,157,507; 1,157,508; 1,157,509; 1,157,510; and U.S. Patents 2,774,668; 2,698,798; 2,698,244; 2,661,293; 2,559,643; etc.

The First Development Step

After the photographic element has been imagewise exposed, it can be developed using any conventional silver halide developer composition. In general, the photographic element can be developed after exposure in a developer solution containing a developing agent, such as a polyhydroxybenzene, aminophenol, paraphenylenediamine, pyrazolidone, pyrazolone, pyrimidine, dithionite, hydroxylamine, hydrazine or other conventional developing agent. A variety of suitable conventional developing agents are disclosed, for example, in *The Theory of the Photographic Process* by Mees and James, 3rd Edition, Chapter 13, titled "The Developing Agents and Their Reactions", published by MacMillan Company (1966), the disclosure of which is here incorporated by reference.

Where the photographic element contains an incorporated color coupler, it is generally preferred that the developer composition employed in the first development step be substantially free of a color-developing agent, since this will lead to dye formation. However, where a low level of silver has been employed in the emulsion layer(s), the amount of dye which is formed, even if a color-developing agent is employed in combination with a color coupler, may be so low as to be negligible. For example, where the preferred photographic elements described above having less than about 30 mg/ft$^2$ (325 mg/m$^2$) silver in each emulsion layer are employed, color images can be formed even though some dye is formed in the first development step.

For exactly the same reasons, where the photographic element contains an RDR, it is preferred that the developer composition employed in the first development step by substantially free of a cross-oxidizing developing agent. A cross-oxidizing developing agent is one which upon oxidation in developing silver halide to silver will react with the RDR so that it releases dye directly or upon hydrolysis. Those developing agents which are not cross-oxidizing developing agents are, of course, designated noncross-oxidizing developing agents and are those which are preferred for use in the first development step where the photographic element contains one or more RDR's. By analogy to the incorporated coupler photographic elements, it is apparent that where a photographic element contains both a low silver density and an RDR any conventional developing agent can be employed in the first development step, since release of dye will be negligible.

The preferred developing agents for use in the first development step where an RDR is present in the photographic element is a noncross-oxidizing developing agent. Particularly preferred noncross-oxidizing developing agents include ascorbic acid and certain derivatives of pyrimidine such as those described by Wyland and Farley in U.S. Pat. No. 3,672,891, issued on June 27, 1972, which is here incorporated by reference. Particularly preferred are 5-amino derivatives of pyrimidine and 5-hydroxy derivatives of pyrimidine, especially 2-methyl-4-amino-5-hydroxypyrimidine-6-one.

The selection between cross-oxidizing developing agents and noncross-oxidizing developing agents is, of course, well within the skill of the art. The patents cited and incorporated by reference above as disclosing RDR's also disclose both cross-oxidizing and noncross-oxidizing developing agents useful in the practice of my process and are additionally incorporated for this teaching.

It is recognized that specific developing agents can be either cross-oxidizing or noncross-oxidizing in developer compositions differing solely in their pH values. It is known that cross-oxidizing silver halide developing agents cease to be cross-oxidizing at lower pH values, although the particular pH value at which a specific developing agent ceases to cross-oxidize varies from one developing agent to another. The proper pH for a developer composition employed in the first step of this invention can be readily determined merely by developing a sample of an exposed photographic element containing a silver halide emulsion layer and associated therein an RDR of the type defined above. If a dye is observed in the developer composition or in the photograhic element being processed, another quantity of developer composition can be made up differing by having a somewhat lower pH and a second sample can be processed therein. If a dye is again observed, the above procedure can be repeated until a pH is reached at which development of the sample ceases to produce observable dye.

The photographic developers employed in the practice of my invention can include, in addition to conventional developing agents, other conventional components. The developers are typically aqueous solutions, although organic solvents, such as diethylene glycol, can also be included to facilitate the solvency of organic components. Since the activity of developing agents is frequently pH-dependent, it is contemplated to include activators for the developing agent to adjust the pH. Activators typically included in the developer are sodium hydroxide, borax, sodium metaborate, sodium carbonate and mixtures thereof. Sufficient activator is typically included in the developer to maintain an alkaline developer solution, usually at a pH above 8.0 and, most commonly, above 10.0 to a pH of about 14. To reduce aerial oxidation of the developing agent and to avoid the formation of colored reaction products, it is commonplace to include in the developer a preservative, such as sodium sulfite. It is also common practice to include in the developer a restrainer, such as potassium bromide, to restrain nonimage development of the silver halide with the consequent production of development fog. To reduce gelatin swelling during development, compounds such as sodium sulfate may be incorporated into the developer. Also compounds such as sodium thiocyanate may be present to reduce granularity. Generally, any photographic developer for silver halide photographic emulsions can be employed in the practice of my invention. Specific illustrative photographic developers and instructions for their use are disclosed in the *Handbook of Chemistry and Physics,* 36th Edition, under the title "Photographic Formulae" at page 3001 et seq. and in *Processing Chemicals and Formulas,* 6th Edition, published by Eastman Kodak Company (1963), the disclosures of which are here incorporated by reference. It is, of course, possible to incorporate the developing agent as well as other developer solution addenda noted above directly in the photographic element so that they are released into the developer solution during the first development step, as is well understood by those skilled in the art.

Poisoning the First Developed Silver Image

In a preferred mode of practicing my process the first developed silver image is poisoned as a redox amplification catalyst for use with a peroxide oxidizing agent as it is developed. This can be accomplished merely by incorporating into the first developer composition a catalyst poisoning agent in an amount sufficient to substantially completely poison the first developed silver image as a catalyst. Alternatively, where the emulsion being developed contains a silver haloiodide, the iodide ion released during development can be relied upon to poison the silver image as a catalyst. Where very rapid development of silver is occurring the absorption of the poison on the silver surface may lag significantly, so that lengthening the development time, increasing the concentration of the poison and/or using a subsequent supplemental poisoning bath may be advantageous to assure complete poisoning. Alternatively the first developed silver image can be poisoned entirely subsequent to the first development step. Subsequent poisoning can be undertaken immediately following first development or after the photographic element has been further processed, such as in a conventional stop and/or rinse bath. Where a separate bath is employed to poison the first developed silver image, this can usually be accomplished merely be dissolving the poisoning agent in water in a concentration similar to that employed in poisoning the silver image in the first developer composition. The pH of the poisoning bath can either be alkaline within the pH ranges normally employed during first development, neutral or acid within the pH ranges normally employed in stop baths. If desired, the poisoning bath can perform both the poisoning and stop functions merely by adding the poisoning agent to a conventional stop bath. It should be apparent that still other variations are possible.

One preferred approach to poisoning the first developed silver image is to choose a first developer composition or to add thereto sufficient halide ion to poison the silver image as it is developed. The effective concentration of the poisoning agent differs as a function of the halide chosen. Generally satisfactory poisoning of the first developed silver image can be achieved using from 1 to 50 grams per liter, preferably 5 to 25 grams per liter, of chloride ion or from 1 to 30 grams per liter, preferably 1 to 15 grams per liter, of bromide ion. As among the various halide ions, iodide ions are preferred, since they are absorbed from tenaciously to the surface of the silver and are effective in much lower concentrations than the remaining halides. Generally effective iodide ion concentrations are from 1 microgram per liter, preferably 1 milligram per liter, to 1 gram per liter, preferably 10 milligrams per liter. Somewhat higher halide concentrations can be employed where a separate poisoning bath is employed, particularly where washing of the photograhic element is contemplated before proceeding to the second development step. Low halide ion concentrations may be useful where background dye density is not objectionable. The halide ions can be incorporated in the processing baths in the form of soluble salts, such as ammonium salts, alkali metal salts, etc.

Mercaptans are also quite useful in poisoning the silver image as a redox amplification catalyst for a peroxide oxidizing agent. Because of their affinity for the silver surface mercaptans can be used in concentrations which, on a molar basis, correspond to those disclosed for iodide ions, that is, about $1 \times 10^{-5}$ to 10 millimoles per liter. Generally any mercaptan known to be useful in silver halide photographic elements or processing solutions can be employed. Exemplary of useful mercaptans are the following:

- Mercaptoalkylamidobenzothiazoles: U.S. Pat. No. 2,503,861,
- Mercaptoalkylamidothiazoles: U.S. Pat. No. 2,657,136, Oct. 27, 1953; U.S. Pat. No. 2,697,099, Dec. 14, 1954
- Mercaptoazines and azoles, etc.; U.S. Pat. No. 2,753,027, Oct. 30, 1951
- Mercaptoazoles: U.S. Pat. No. 2,131,038, Sept. 27, 1938; U.S. Pat. No. 2,353,754, July 18, 1944; U.S. Pat. No. 2,432,865, Dec. 16, 1947; U.S. Pat. No. 2,453,346, Nov. 9, 1948; U.S. Pat. No. 2,566,659, Sept. 4, 1951; U.S. Pat. No. 2,668,113, Feb. 2, 1954; U.S. Pat. No. 2,590,775, Mar. 25, 1952
- Mercaptocysteines: U.S. Pat. No. 2,363,777, Nov. 28, 1944
- Mercaptoglutathiones: U.S. Pat. No. 2,110,178, Mar. 8, 1938
- Mercaptooxadiazoles: U.S. Pat. No. 2,843,491, July 15, 1958
- Mercaptopyrimidines, etc.: U.S. Pat. No. 2,173,628, Sept. 19, 1939; U.S. Pat. No. 2,231,127, Feb. 11, 1948; U.S. Pat. No. 2,232,707, Feb. 25, 1941; U.S. Pat. No. 2,304,962, Dec. 15, 1942
- Mercaptotetrazoles: U.S. Pat. No. 2,403,927, July 16, 1946; U.S. Pat. No. 2,453,087, Nov. 2, 1948; U.S. Pat. No. 2,465,149, Mar. 22, 1949; U.S. Pat. No. 2,697,040, Dec. 14, 1954
- Mercaptothiadiazoles: U.S. Pat. No. 2,743,184, Apr. 24, 1956

Mercaptothiazoles: U.S. Pat. No. 2,759,821, Aug. 21, 1956; U.S. Pat. No. 2,824,001, Feb. 18, 1958

Mercaptothiophenes: U.S. Pat. No. 1,758,576, May 13, 1930; U.S. Pat. No. 2,214,446, Sept. 10, 1940

Mercaptotriazines: U.S. Pat. No. 2,476,536, July 19, 1949

Mercaptotriazoles, etc.: Aust. P. 125,480, Nov. 26, 1943

Misc. mercaptans: U.S. Pat. No. 3,017,270, Jan. 16, 1962. Instead of employing mercaptans directly it is possible to use compounds which are precursors of mercaptans and which convert to mercaptans under processing conditions. Example, disulfides, such as 6,8-dithiooctanoic acid; 3-(p-N,N-diphenylaminophenyl)-5-phenyl dithiolium perchlorate; etc., are known to convert to mercaptans in aqueous solution. Also acyclic disulfides of the type disclosed for use as antifoggants by Millikan and Herz U.S. Pat. No. 3,397,986, issued Aug. 20, 1968, can be employed. The mercaptans can be employed in the form of hydrolyzable metal salts, if desired.

Conventional silver halide antifoggants of various types which are free of mercapto groups can also be employed as catalyst poisons. These antifoggants are useful catalyst poisons within the conventional antifoggant concentrations above 1 gram per liter. Although antifoggants exhibit differing optimum concentrations, useful levels of catalyst poisoning can be obtained in the range of from about 1 gram per liter to 30 grams per liter, preferably from about 2 to 10 grams per liter where the antifoggant neither has nor is capable of forming a mercapto substituent.

Exemplary useful antifoggants include the following:

Oxazole, selenazole and thiazole antifoggants of the type disclosed by Brooker et al U.S. Pat. No. 2,131,038, issued Sept. 27, 1938;

Imidazole antifoggants of the type disclosed by Weissberger et al U.S. Pat. No. 2,324,123, issued July 13, 1943; Bean U.S. Pat. No. 2,384,593, issued Sept. 11, 1945 and DeSelms U.S. Pat. No. 3,137,578, issued June 16, 1964;

Urazole antifoggants of the type disclosed by Carroll et al U.S. Pat. No. 2,708,162, issued May 10, 1955;

Tetrazaindene antifoggants of the type disclosed by Carroll et al U.S. Pat. No. 2,716,062, issued Aug. 23, 1955; Piper U.S. Pat. No. 2,886,437, issued May 12, 1959; Heimbach U.S. Pat. No. 2,444,605, issued July 6, 1948;

Isothiouronium salt antifoggants of the type disclosed by Herz et al U.S. Pat. No. 3,220,839, issued Nov. 30, 1965;

Cyclic hydrazide antifoggants of the type disclosed by Anderson et al U.S. Pat. No. 3,287,135, issued Nov. 22, 1966; Milton U.S. Pat. No. 3,295,981, issued Jan. 3, 1967;

Pyrazolidone antifoggants of the type disclosed by Milton U.S. Pat. No. 3,420,670, issued Jan. 7, 1969;

Aminomethylthiocarboxylic acid antifoggants of the type disclosed by Cossar et al U.S. Pat. No. 3,547,638, issued Dec. 15, 1970;

Tetrazole antifoggants of the type disclosed by Tuite et al U.S. Pat. No. 3,576,638, issued Apr. 27, 1971;

Thiazoline-2-thione antifoggants of the type disclosed by Herz U.S. Pat. No. 3,598,598, issued Aug. 10, 1971;

4-Pyrimidinethione antifoggants of the type disclosed by Lamon U.S. Pat. No. 3,615,621, issued Oct. 26, 1971;

4-Thiouracil antifoggants of the type disclosed by Lamon U.S. Pat. No. 3,622,340, issued Aug. 12, 1968;

Nitron;

Nitroimidazole antifoggants, such as 6-nitroimidazole; 5-nitro-1H-imidazole;

Triazole antifoggants, such as benzotriazole; 5-methyl-benzotriazole; 5,6-dichlorobenazotriazole; 4,5,6,7-tetrachloro-1H-benzotriazole;

Sulfocatechol antifoggants of the type disclosed by Kennard et al U.S. Pat. No. 3,236,652, issued Feb. 22, 1966; and Similar known antifoggants.

It is also possible to use as poisoning agents in the first developer composition soluble development inhibitor releasing (DIR) couplers of the type disclosed, for example, by Barr et al U.S. Pat. No. 3,227,554, issued Jan. 4, 1966. It is additionally possible to achieve poisoning employing developing agents containing antifoggant moieties as substituents. For example, it is specifically contemplated to employ dihydroxyaryl developing agents, such as p-benzohydroquinones and 1,4-naphthohydroquinones which are substituted with antifoggant moieties, such as benzotriazolyl and/or phenylmercaptotetrazolyl substituents.

Where it is desired to poison the developing silver during the first development step, it is possible to incorporate into the photographic element the silver poison. This can be accomplished merely be incorporating in the photographic element any of the mercaptans or antifoggants described above in the manner known to art—e.g., in the manner taught by the various patents cited. Where a halide is being employed as a catalyst poison, it can be incorporated in the form of any ionizable compound which is compatible with the photographic element. For example, the halide can be incorporated in the form of a water soluble inorganic halide salt, such as an alkali metal chloride, bromide or iodide.

Preparation for the Second Development Step

After the first development step and poisoning the silver image produced thereby, it may be desirable before proceeding to the second development step to render the silver halide remaining in the photographic element developable. This can be accomplished conveniently by flash exposing the photographic element to actinic radiation so that a developable latent image is formed in the remaining silver halide grains. As an alternative conventional approach, the photographic element can be treated with a processing solution containing a nucleating agent, i.e., a fogging agent, so that the surface of the undeveloped silver halide grains are fogged and thereby rendered developable. Where nucleation of the undeveloped silver halide is undertaken to render the grains developable, it is preferred that this be accomplished by adding a nucleating agent to the second developer composition, as disclosed below, rather than through use of a separate processing solution. It is also possible to employ stop and wash baths between the first and second development steps. The desirability of undertaking such washing steps will vary, depending upon the amount, silver surface affinity and potency of the particular poisoning agent employed. For example, in many instances bromide ions will be washed from the surface of the silver and lose their effectiveness as a poison while even lower concentrations of iodide ions will under the same washing conditions remain on the silver and remain effective as a poison. It is generally preferred to minimize processing of the photographic element between the first and second development steps, except where a highly adherent poison like iodide ion is employed.

The Second Development Step

In the second development step the developer composition can be identical to that employed in the first development step where the developer ingredients are incorporated initially entirely in the developer composition. Any catalyst poison which may be present is preferably maintained at a concentration below that disclosed above to be effective. Generally, I prefer that the second developer composition be at least initially substantially completely free of any substance which will poison the developing silver as a redox amplification catalyst for a peroxide oxidizing agent. Catalyst poison initially present in the photographic element or picked up in the first development step will typically be adsorbed to the surface of the first developed silver and will not contaminate the additional silver formed in the second development step. Further, introducing unadsorbed poison into the second developer can be avoided by leaching in processing solutions between the first and second development steps—e.g., in intervening stop and/or wash baths.

Where it is desirable to render developable the silver halide grains not developed in the first development step through the use of a nucleating agent, a conventional nucleating agent can be incorporated within the second developer composition. Exemplary nucleating agents, their effective concentrations and the procedures for their use are disclosed by Glass et al U.S. Pat. No. 2,507,154, issued May 9, 1950; Ives U.S. Pat. No. 2,533,463, issued Dec. 12, 1950; Ives U.S. Pat. No. 2,563,785, issued Aug. 7, 1951; Ives U.S. Pat. No. 2,588,982, issued Mar. 11, 1952; Whitmore U.S. Pat. No. 3,227,552, issued Jan. 4, 1966; and Olivares et al U.S. Pat. No. 3,782,949, issued Jan. 1, 1974. Falleson U.S. Pat. No. 2,497,875, issued Feb. 21, 1950, teaches development under conditions which promote fogging of silver halide grains which can be employed in the practice of my process.

In the second development step a color-developing agent can be employed whether or not either the second developer composition or the photographic element contains a color coupler. If a coupler is available when the color-developing agent is employed, a dye image will be formed which can be later amplified by the redox amplification step. Alternatively, the redox amplification step can be relied upon to form the entire dye image.

Any primary aromatic amine color-developing agent can be used in the process of my invention, such as p-aminophenols, p-phenylenediamines, or p-sulfonamidoanilines. Color-developing agents which can be used include 3-acetamido-4-amido-4-amino-N,N-diethylaniline, 4-amino-N-ethyl-N-β-hydroxyethylaniline sulfate, N,N-diethyl-p-phenylenediamine, 2-amino-5-diethylaminotoluene, N-ethyl-N-β-methanesulfonamidoethyl-3-methyl-4-aminoaniline, 4-amino-N-ethyl-3-methyl-N-(β-sulfoethyl)aniline and the like. See Bent et al, JACS, Vol. 73, pp. 3100–3125 (1951), and Mees and James, *The Theory of the Photographic Process,* 3rd Edition, 1966, published by MacMillan Co., New York, pp. 278–311, for further typical useful developing agents. Aromatic primary amino color-developing agents which provide particularly good results in this invention are 4-amino-N,N-diethylaniline hydrochloride, 4-amino-3-methyl-N,N-diethylaniline hydrochloride, 4-amino-3-methyl-N-ethyl-N-β-(methanesulfonamide)ethylaniline sulfate hydrate, 4-amino-3-methyl-N-ethyl-N-β-hydroxyethylaniline sulfate, 4-amino-3-dimethylamino-N,N-diethylaniline sulfate hydrate, 4-amino-3-methoxy-N-ethyl-N-β-hydroxyethylaniline hydrochloride, 4-amino-3-β-(methanesulfonamide)ethyl-N,N-diethylaniline dihydrochloride and 4-amino-N-ethyl-N-(2-methoxyethyl)-m-toluidine di-p-toluene sulfonate.

A black-and-white developing agent can be used in combination with color-developing agent. Upon reaction with the undeveloped silver halide grains, oxidized black-and-white developer can cross-oxidize with the color-developing agent to generate oxidized color-developing agent which can form dye by reaction with color couplers, if present.

Both the black-and-white and color-developing agents employed in both the first and second development steps are present in conventional concentration ranges. Where the black-and-white developing agent is acting to cross-oxidize the color-developing agent, it is generally preferred that roughly stoichiometric proportions be maintained—e.g., a mole ratio of 2:1 to 0.5:1 black-and-white developing agent to color-developing agent. Where the developing agents are acting as competing developing agents their relative proportions can be varied without limit. While any conventional concentrations of developing agent(s) can be employed, typically the first and second developer compositions will contain from about 1 to 20, most typically from about 2 to 10, grams per liter of developer composition.

The Amplification Step

In one form of my invention, after forming an imagewise distribution of unpoisoned catalytic silver during the second development, I transfer the photographic element being processed to a peroxide oxidizing agent containing redox amplification bath. The amplification bath can take the form of conventional peroxide oxidizing agent containing redox amplification baths of the type disclosed in U.S. Pat. Nos. 3,674,490 and 3,776,730, each cited above. The bath can also take the form of that disclosed in British Pat. No. 1,329,444 or "Image Amplification Systems", Item No. 11660 of *Research Disclosure,* cited above. The disclosures of each of the above are herein incorporated by reference. These redox amplification baths are aqueous solutions containing a peroxide oxidizing agent.

The peroxide oxidizing agents employed in the practice of my invention can be chosen from among conventional peroxide oxidizing agents which are known to require the presence of a catalyst surface to oxidize a dye-image-generating reducing agent. Peroxide oxidizing agents of this type include water-soluble compounds containing a peroxy group, such as inorganic peroxide compounds or salts of peracids. For example, perborates, percarbonates or persilicates and, particularly, hydrogen peroxide, can be employed as peroxide oxidizing agents in the practice of my invention as well as organic peroxide compounds such as benzoyl peroxide, percarbamide and addition compounds of hydrogen peroxide and aliphatic acid amides, polyalcohols, amines, acylsubstituted hydrazines, etc. I prefer to employ hydrogen peroxide, since it is highly active and easily handled in the form of aqueous solutions. Peroxide oxidizing agent concentrations of from 0.001 mole to 0.5 mole per liter of amplification bath are preferred.

Except where an immobile dye-image-generating reducing agent, such as an RDR, is incorporated in the photographic element, the redox amplification bath contains a mobile dye-image-generating reducing agent. This dye-image-generating reducing agent can be of any conventional type heretofore employed in redox amplification baths. In one form, the dye-image-generating reducing agent is a compound which forms a highly colored reaction product upon oxidation or which upon oxidation is capable of reacting with another compound, such as a color coupler, to form a highly colored reaction product. Where the dye-image-generating reducing agent forms a colored reaction product directly upon oxidation, it can take the form of a dye precursor such as, for example, a leuco dye or vat dye that becomes highly colored upon oxidation.

Where the dye-image-generating reducing agent is oxidized to form a highly colored reaction product with another compound, such as a color coupler, the dye-image-generating reducing agent is preferably employed in the form of a color-developing agent. The coupler to be employed in combination with the color developing agent can be present in the redox amplification bath in the same concentrations normally employed in color developer compositions. In a preferred form, however, the coupler is incorporated in the photographic element to be processed.

Instead of producing a colored reaction product upon oxidation, the dye-image-generating reducing agent can be of a type which is initially colored, but which can be used to provide an imagewise distribution of image dye by alteration of its mobility upon oxidation. Dye-image-generating reducing agents of this type include dye developers of the type disclosed, for example, in Rogers U.S. Pat. Nos. 2,774,668 (issued Dec. 18, 1956) and 2,983,606 (issued May 9, 1961), here incorporated by reference. These compounds are silver halide developing agents which incorporate a dye moiety. Upon oxidation by the peroxide oxidizing agent directly or acting through a cross-oxidizing auxiliary silver halide developing agent (such as described above), the dye developer alters its mobility to allow a dye image to be produced. Typically, the dye developer goes from an initially mobile to an immobile form upon oxidation in the redox amplification bath.

The amount of mobile dye-image-generating reducing agent incorporated within the amplification bath can be varied over a wide range corresponding to the concentrations in conventional photographic developer baths. The amount of color-developing agent used in the amplification bath is preferably from about 1 to 20 and, most preferably, from about 2 to 10 grams per liter, although both higher and lower concentrations can be employed.

Where the photographic element initially contains one or more RDR's acting as dye-image-generating agents, the redox amplification bath contains a cross-oxidizing developing agent (also referred to in this type of application as an electron transfer agent). Any of the black-and-white developing agents used with color-developing agents, as described above to perform cross-oxidation, can be employed. Exemplary useful cross-oxidizing developing agents are also described in the patents referred to above disclosing RDR's and their use. Illustrative examples of preferred developing agents useful as cross-oxidizing developing agents (or electron transfer agents) in practicing this invention include 1-phenyl-3-pyrazolidone, 1-phenyl-4,4-dimethyl-3-pyrazolidone and 4-hydroxymethyl-4-methyl-1-phenyl-3-pyrazolidone.

Redox dye-releasers are similar to color-developing agents employed in combination with cross-oxidizing developing agents in that redox dye-releasers react through an intermediate redox couple provided by a cross-oxidizing silver halide developing agent. In this redox couple the silver halide developing agent reacts with the peroxide oxidizing agent on a catalytic surface to form oxidized developing agent. The oxidized developing agent then reacts with the redox dye-releaser and is regenerated. The oxidized redox dye-releaser hydrolyzes in an aqueous alkaline medium provided by the amplification bath to release mobile dye.

The term "nondiffusible" used herein as applied by dye-image-generating reducing agents, couplers, dyes and their reaction products has the meaning commonly applied to the term in color photography and denotes materials which for all practical purposes do not migrate or wander through photographic hydrophilic colloid layers, such as gelatin, during processing in aqueous alkaline solutions. The same meaning is attached to the term "immobile". The terms "diffusible" and "mobile" have meanings converse to the above.

Since the dye-image-generating reducing agents employed in the practice of my process have heretofore been employed in the art in silver halide photographic elements and developer solutions, best results can be obtained by maintaining the amplification bath within the alkaline pH ranges heretofore employed in developing photographic silver halide emulsions to form dye images using these dye-image-generating reducing agents. Preferred alkalinity for the amplification bath is at least 8, most preferably from 10 to about 14. The amplification bath is typically maintained alkaline using activators of the type described above in connection with the developing step of my process.

Other addenda known to facilitate image-dye formation in alkaline photographic developer solutions with specific dye-image-generating reducing agents can also be included in the amplification bath. For example, where incorporated color couplers are employed, it may be desirable to incorporate an aromatic solvent such as benzyl alcohol to facilitate coupling. Where lower pH alkaline purification baths are being employed in combination with RDR-containing photographic elements, the mobility of the released dye can be enhanced by incorporating amino acids or combinations of amines and aliphatic carboxylic acids. Exemplary useful compounds include ω-amino acids, such as 2-aminoacetic acid, 4-aminobutyric acid, 6-aminohexanoic acid, 11-aminoundecanoic acid and 12-aminododecanoic acid. Such released dye solubilizers can be present in the amplification bath in concentrations of from about 0.1 to 60 grams per liter, preferably from about 1 to 20 grams per liter.

Further Processing, Alternatives And Advantages

The foregoing description of my process can be characterized as a sequential mode of practicing my invention in that separate second development and amplification baths are employed. Stop and rinsing steps of a conventional character can, if desired, be employed between the second development and the amplification step. Where it is desired to view the dye image within the photographic element being processed, it is contemplated that stop, bleach and rinse steps of a conventional nature can be practiced after removing the photographic element from the amplification bath. Where low levels of silver are present, as can be made possible through redox amplification of the dye image, very little, if any difference may be observed as between photographic elements which have been bleached and those which have not been bleached to remove silver.

In an alternative, preferred, mode of practicing my process, the second development and amplification steps can be accomplished in a combined second development and amplification bath. In a simpler form, this can be accomplished merely by adding one or more peroxide oxidizing agents of the type and in the concentrations described above to one of the second development baths described above. In a specific preferred form, the combined second development and amplification bath is comprised of an aqueous alkaline solution having a pH of at least 8, preferably in the range of from 10 to about 14, with the activators described above being relied upon to adjust and control alkalinity. In addition, the combined bath contains at least one silver halide developing agent and at least one peroxide oxidizing agent. An immobile dye-image-generating reducing agent is incorporated in the photographic element or, if mobile, is incorporated in the combined development and amplification bath. A single color-developing agent can, of course, perform the functions of and serve as both the silver halide developing agent and the dye-image-generating reducing agent. It is specifically contemplated that one or more color couplers can also be present in the combined second development and amplification bath, although they are preferably incorporated, when used, in the photographic element being processed. Where the photographic element contains a silver haloiodide used in imaging, it is essential that the second development and amplification steps be performed using a combined second development and amplification bath. Otherwise the silver developed during the second development step would be poisoned as a catalyst for the redox amplification reaction before it could reach the amplification bath. While it has been observed that silver haloiodides can be developed in a combined second development and amplification bath and that an amplified dye image can be obtained using a peroxide oxidizing agent, the exact mechanism that permits this to occur has not been determined.

Where a dye-image-generating agent such as a dye-developer or redox dye-releaser is employed which forms a complementary pattern of mobile and immobile forms, the mobile forms must be separated from the immobile forms in most instances in order for a visible image to be produced. A transferred image can be formed by allowing the mobile form to diffuse to a image receiver. Alternatively or additionally, a retained image can be formed once the mobile form has diffused from or been washed from the photographic element. Washing is most easily accomplished using an aqueous alkaline solution having a pH of at least 8, most preferably from 10, to about 14. Conventional image receivers and dye transfer procedures as disclosed in the dye-developer and RDR patents cited above can be employed in the practice of my process.

Where the first development step and the step of poisoning the silver image formed thereby are concurrently carried out in a single first development bath and the second development and redox amplification steps are concurrently carried out in a combined second development and amplification bath, my process is manipulatively no more complex than a conventional silver halide reversal imaging process. At the same time, it is not necessary to modify the structure of the photographic element in any way from that of a conventional photographic element being employed to form reversal images. (Although, the desirable advantage can be obtained of allowing the photographic element to contain less silver than would be necessary absent redox amplification.) It is accordingly apparent that I have accomplished what has heretofore eluded those skilled in the art in applying redox amplification to reversal processing. I have not found it necessary to add to or depart radically from the manipulative steps of conventional reversal processing, and I have not found it necessary to introduce complicating photographic element features in obtaining the advantages of amplification in reversal processing. Using my present reversal process I do not find it necessary to employ a bleach step between the first and second development steps or to employ palladium nuclei as disclosed in my earlier cobalt(III) complex amplification processes for obtaining reversal images. Neither do I find it necessary to decompose hydrogen peroxide on a silver surface and to rely on still another catalyst to promote redox amplification as disclosed by Matejec.

EXAMPLES

The practice of my invention can be better appreciated by reference to the following examples:

Example 1 — The Effect of Catalyst Poisoning With Iodide on Peroxide Redox Reversal Imaging A. A photographic element having a film support and a gelatino-silver halide emulsion layer coated thereon was prepared. The emulsion coating contained the ingredients set forth below in Table 1. Unless otherwise stated, all coating densities in the examples are reported parenthetically in terms of mg/0.093 meter$^2$ (i.e., mg/ft$^2$). Silver halide densities are reported in terms of silver. Unless otherwise stated, all processing and processing solutions were at 24° C.

Table 1

Photographic Element 1-A

Gelatino-Silver Halide Emulsion Layer: Silver Halide (3.16); Gelatin (400); Coupler Solvent Di-n-butyl phthalate (25); Cyan-Dye-Forming Coupler 2-[α-(2,4-Di-tert-amylphenoxy)-butyramido]-4,6-dichloro-5-methylphenol (100)

Transparent Cellulose Triacetate Film Support

The silver halide employed was monodispersed, sulfur and gold chemically sensitized cubic grain silver bromide having a mean grain size of 0.8 micron.

B. A first sample of the photographic element was exposed with a white light source through a graduated-density test object having 21 equal density steps ranging from 0 density at Step 1 to a density of 3.0 at Step 21. The exposed sample was then developed for 1 minute in a black-and-white developer solution of the composition set forth below in Table 2.

Table 2

| Black-and-White Developer* | |
|---|---|
| Sodium Sulfite, desiccated | 90.0 g |
| Hydroquinone | 8.0 g |
| Sodium Carbonate, monohydrated | 52.5 G |
| Potassium Bromide | 5.0 g |

Table 2-continued

| Black-and-White Developer* | |
|---|---|
| p-Methylaminophenol sulfate | 2.0 g |
| Water to 1 liter | |

Commercially available under the trademark Kodak Developer D-19.

The sample was then immersed for 30 seconds in a stop bath formed by a solution of 1 percent by weight acetic acid in water and then immersed for 60 seconds in a fix bath of the composition set forth in Table 3.

Table 3

| Fix Bath* | |
|---|---|
| Sodium Thiosulfate | 240.0 g |
| Sodium Sulfite, desiccated | 10.0 g |
| Sodium Bisulfite | 25.0 g |
| Water to make 1 liter | |

*Commercially available under the trademark Kodak Fixing Bath F-24.

The sample was then washed and dried. A second sample was identically exposed and processed, except that 0.005 g per liter of potassium iodide was added to the black-and-white developer.

The silver characteristic curve obtained for the negative or black-and-white developed silver was an essentially horizontal line having a density of roughly 0.03. This indicated that black-and-white development produced a very slight contribution to element density. Also, the characteristic curves for the first and second samples were substantially identical, indicating that the presence or absence of potassium iodide in the developer was not significantly affecting performance. The results are shown as Curves 1 and 2 in FIG. 1 for the first and second samples, respectively.

C. Third and fourth samples of the photographic element of paragraph 1-A were exposed and processed identically to the first and second samples, respectively, through the step of processing in the stop bath. Thereafter, both samples were washed in water for 2 minutes, fogged by exposure to white light for 1 minute, developed for 6 minutes in a color developer solution of the composition set forth in Table 4 below, placed in a second stop bath identical to the first stop bath for 30 seconds, and finally washed and dried.

Table 4

| Color Developer | |
|---|---|
| $Na_2SO_3$ | 2.0 g |
| 4-Amino-3-methyl-N-ethyl-N-β-(methanesulfonamido)-ethylaniline | 5.0 g |
| $Na_2CO_3$ | 20.0 g |
| Water to 1 liter (pH 12.5) | |

The characteristic curve produced by developed silver and cyan dye was substantially identical in the third and fourth samples, indicating that the iodide in the black-and-white developer had no significant effect on the density of the image obtained. The characteristic curves 3 and 4 are shown in FIG. 1 for the third and fourth samples, respectively. They indicate that the dye and silver developed would provide only a small contribution to image density upon formation of a dye image.

D. Three pairs of samples identical to those described above were exposed and processed as described above in paragraph 1-C, except that the pairs were color-developed for 2, 4 and 6 minutes, respectively. One of the samples from each pair was developed in black-and-white developer containing 0.005 gram per liter of potassium iodide, while the remaining sample in each pair was developed in the black-and-white developer of Table 2 lacking potassium iodide. The only other modification that was undertaken was to add 5.0 ml of a 30 percent by weight solution of hydrogen peroxide to the color-developer solution.

The characteristic curves obtained are shown in FIG. 1, wherein Curves 5, 7 and 9 represent the characteristic curves obtained with 2-, 4- and 6-minute color developments, respectively, and without potassium iodide present in the black-and-white developer. Curves 6, 8 and 10 represent the characteristic curves obtained with 2-, 4- and 6-minute color developments, respectively, with iodide present in the black-and-white developer.

The characteristic curves are produced by both dye and silver; however, from paragraphs 1-B and 1-C it is apparent that the silver density and dye density from conventional color development was slight as compared with the total density observed. Thus, image density is primarily a function of redox amplification dye density rather than conventional development dye density or silver density. It is apparent that without iodide poisoning of the black-and-white developed silver, contrast is exceedingly poor and minimum densities are unacceptably high. Curves 6, 8 and 10 are interrupted but, if extended, would approximately merge with curves 3 and 4.

E. In the foregoing processing sufficient bromide was present in the black-and-white developer to act as a catalyst poison for the black-and-white developed silver. However, little or no poisoning effect was observed attributable to the bromide ions, since the photographic element samples were in each instance immersed in the stop bath and then washed for 2 minutes before proceeding to the color development step. The fact that the potassium iodide, although present in much smaller quantities, survived these intermediate steps while the bromide ions did not illustrate the superiority of iodide as a catalyst poison as compared to bromide ions in this type of application.

EXAMPLE 2 — THE EFFECT OF CATALYST POISONING WITH BROMIDE ON PEROXIDE REDOX REVERSAL IMAGING

Figure 2:
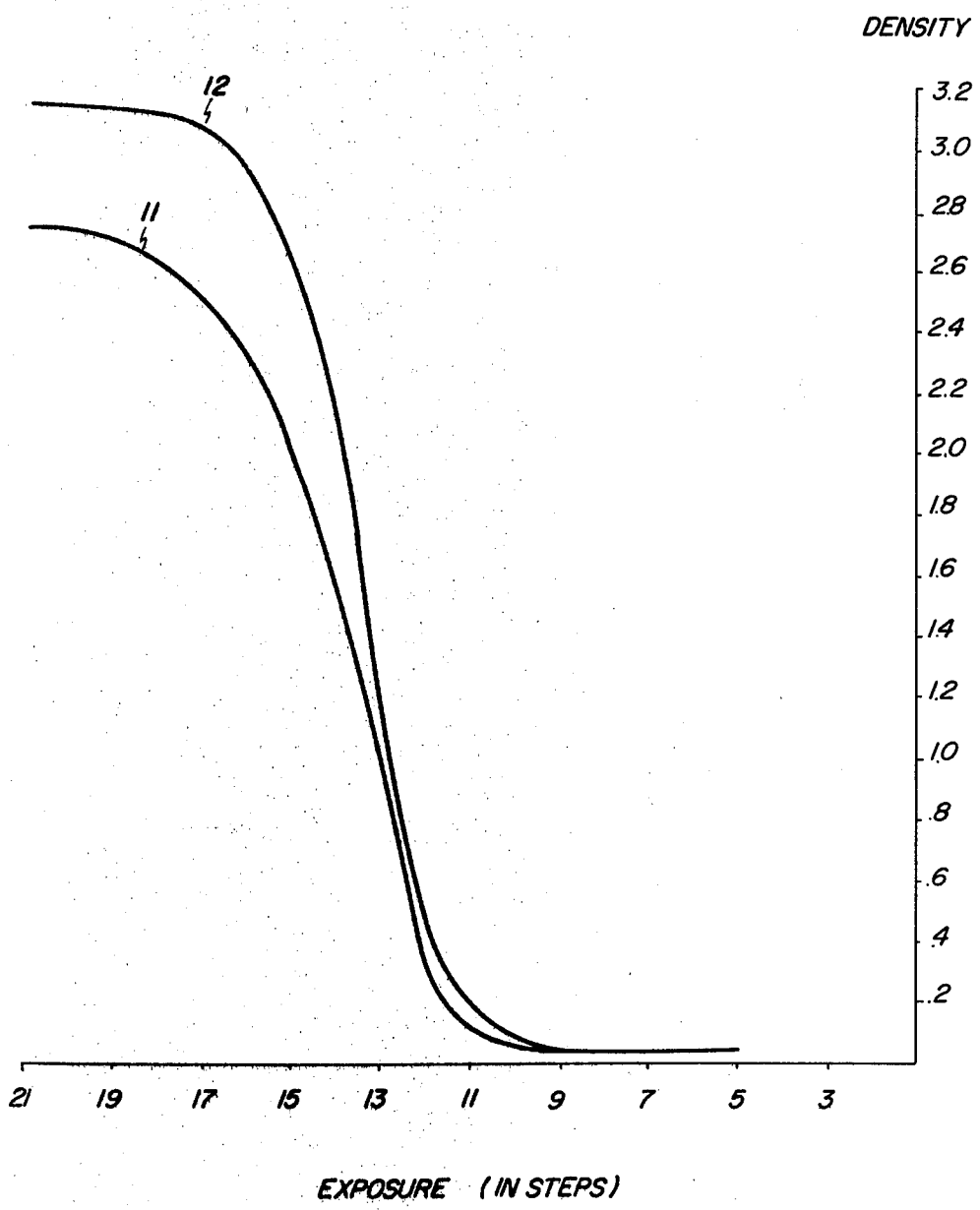

A. A photographic element identical to that of Example 1 was prepared, except that 100 mg/ft$^2$ or mg/0.093 m$^2$ of silver halide was present in the emulsion layer. A first sample of the photographic element was exposed identically as in paragraph 1-B and then developed for 2 minutes in the black-and-white developer of Table 2. The sample was then immersed in color developer of the composition of Table 4, but with the addition of 0.5 gram per liter potassium bromide and the pH adjusted to 10.2. After 30 seconds the sample was given a uniform panchromatic flash exposure with white light and color-developed for a total time of 5 minutes. Thereafter the sample was processed through a stop bath, a silver bleach bath, and a fix bath, then washed and dried in a conventional manner. The resulting characteristic curve produced by the cyan dye is shown as Curve 11 in FIG. 2. Curve 11 thus illustrates conventional reversal processing.

B. A second sample of the photographic element of paragraph 2-A was identically exposed and processed as described above, except that 2 grams per liter of sodium perborate, a peroxide oxidizing agent, was added to the color developer composition. The resulting characteristic curve is shown as Curve 12 in FIG. 2. Comparing Curves 11 and 12 it can be seen that a higher maximum density is obtained by Curve 12, indicating the effectiveness of the peroxide redox reaction in amplifying the dye image. At the same time the minimum densities of Curves 11 and 12 are substantially identical, indicating that the silver formed during black-and-white development was effectively poisoned as a redox amplification catalyst for the peroxide oxidizing agent. Further, it is apparent that the small amount of potassium bromide incorporated in the color developer solution was insufficient to poison the color developed silver image.

EXAMPLE 3 — APPLICATION TO A COMMERCIAL MULTICOLOR BROMOIODIDE REVERSAL FILM

A. A first sample of a multicolor reversal film containing three separate layer units formed by silver bromoiodide emulsion layers each containing about 6 mole percent iodide, based on total halide, was employed. The reversal film was of the incorporated color coupler type and is commercially available under the trademark Ektachrome. The sample was exposed in separate areas to panchromatic light through red, green and blue filters and then processed by a procedure similar to the Ektachrome E4 reversal process, which is fully described in the *British Journal of Photography Annual* (1973), pp. 208–210, except for the differences expressly noted as follows: The processing temperature was 38° C.; the sample was immersed in a prehardener bath of the composition set forth in Table 5 for 2 minutes, immersed in a neutralizer of the composition set forth in Table 6 for 30 seconds, immersed in the black-and-white developer of the composition set forth in Table 7 for 2 minutes and 45 seconds, immersed in an acid rinse following each development for 1 minute, washed with water for 30 seconds, immersed in the color developer of the composition set forth in Table 8 for 2 minutes, acid rinsed for 2 minutes, washed with water for 1 minute, bleached for 4 minutes, fixed for 4 minutes and washed with water for 4 minutes.

Table 5

| Prehardener | | |
|---|---|---|
| p-Toluene sulfinic acid, sodium salt | 0.5 | g |
| Dimethoxytetrahydrofuran | 4.3 | ml |
| Sodium sulfate | 154.0 | g |
| Sodium bromide | 2.0 | g |
| Sodium acetate | 20.0 | g |
| Formalin (37.5 percent by weight solution) | 27.0 | ml |
| N-methylbenzothiazolium-p-toluene sulfonate | 0.02 | g. |
| Water to 1 liter; pH adjusted to 4.8 with $H_2SO_4$ | | |

Table 6

| Neutralizer | | |
|---|---|---|
| Hydroxylamine sulfate | 22.0 | g |
| Sodium bromide | 17.0 | g |
| Glacial acetic acid | 10.0 | ml |
| Sodium hydroxide | 6.0 | g |
| Sodium sulfate | 50.0 | g |
| Water to 1 liter; pH 5.0 | | |

Table 7

| Black-and-White Developer | | |
|---|---|---|
| Sodium hexametaphosphate | 2.0 | g |
| $NaHSO_3$ | 8.0 | g |
| 1-Phenyl-3-pyrazolidone | 0.35 | g |
| $Na_2SO_3$ | 44.0 | g |
| Hydroquinone | 5.5 | g |
| $Na_2CO_3$ | 28.2 | g |
| NaCNS | 1.38 | g |
| NaBr | 1.3 | g |
| KI (0.1 percent by weight in water) | 13.0 | ml |
| Water to 1 liter; pH 9.9 | | |

Table 8

| Color Developer | | |
|---|---|---|
| Sodium hexametaphosphate | 5.0 | g |
| Benzyl alcohol | 4.5 | ml |
| Sodium sulfite | 7.5 | g |
| Trisodium phosphate . $12H_2O$ | 36.0 | g |
| NaBr | 0.9 | g |
| KI (0.1 percent by weight in water) | 90.0 | ml |
| Citrazinic acid | 1.5 | g |
| 4-Amino-3-methyl-N-ethyl-N-β (methanesulfonamido)ethylaniline | 11.0 | g |
| Ethylenediamine | 3.0 | g |
| tert-Butylamine borane nucleating agent | 0.07 | g |
| Water to 1 liter; pH adjusted to 11.55 with NaOH | | |

Figure 3:
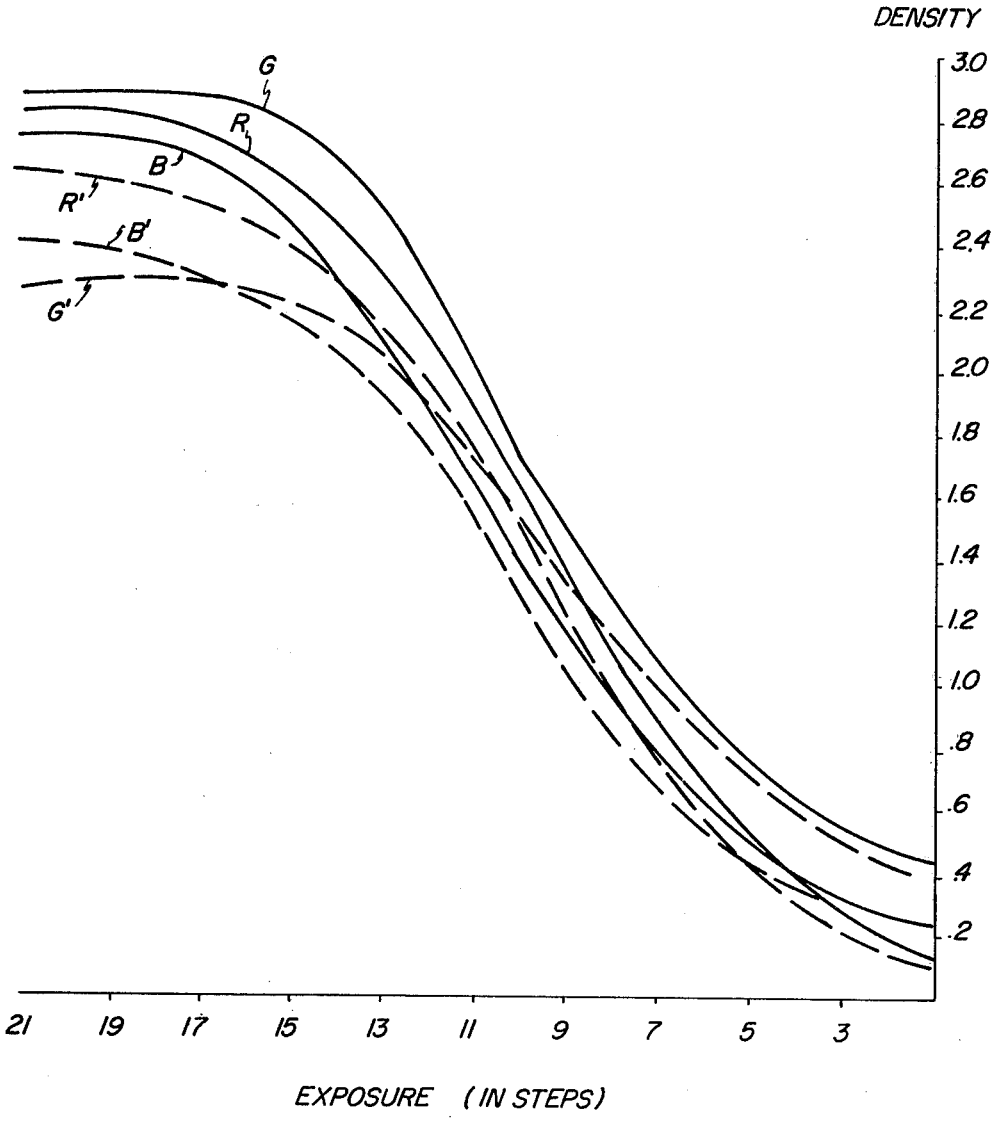

The characteristic curves for the blue-sensitive (yellow image dye), green-sensitive (magenta image dye) and red-sensitive (cyan image dye) layers of the sample are indicated by the letters B′, G′ and R′, respectively, shown in dashed lines in FIG. 3.

B. A second sample of the Ektachrome film was identically exposed and processed, except that 10 ml per liter of a 30 percent by weight solution of hydrogen peroxide in water was added to the color developer. The results are shown in FIG. 3, wherein the Curves R, G and B correspond to Curves R′, G′ and B′, respectively. It can be seen that the peroxide oxidizing agent produces an increase in the maximum dye density without a corresponding increase in the minimum dye density occurring. Besides the obvious advantage of higher maximum dye densities these results can be used to shorten the color development time of the color reversal film and/or to allow the film to contain lower silver densities. The example illustrates the surprising compatibility of my invention with multicolor reversal processes and photographic elements of the type presently in common use.

This example illustrates the further surprising discovery that the presence of a catalyst poison in the color developer is not effective to prevent redox amplification from occuring. In this regard, it is to be noted that a higher concentration of iodide was present in the color developer than in the black-and-white developer. However, only the silver developed in the first development step was effectively poisoned.

EXAMPLE 4 — THE EFFECT OF USING A SILVER CHLORIDE EMULSION

A procedure qualitatively similar to that used to obtain Curves 6, 8 and 10 in FIG. 1 was applied to three samples of an otherwise qualitatively similar photographic element containing a monodispersed silver chloride having a mean grain diameter of 0.7 micron. The silver chloride grains were sulfur and gold sensitized and coated in gelatin at a density of 11.1 mg/0.093 meter$^2$. In color developing for 4 minutes a maximum density was obtained of 3.75, with a minimum density of about 0.3. When the color development time was reduced to 2 minutes and 1 minute, maximum densities of 2.7 and 1.5, respectively, were obtained, with somewhat lower minimum densities also being observed. This example then illustrates the applicability of my process to silver chloride emulsions. The higher maximum densities obtained as compared with Example 1 was a function of the higher silver halide coating densities employed.

EXAMPLE 5 — THE EFFECT OF SILVER HALIDE GRAIN SIZE

The procedures of Example 4 were repeated, but with the sole variation that the silver chloride grains exhibited a mean grain diameter of 0.2 micron. The maximum obtainable image density of 3.75 was in each of the 1, 2 and 4 minute color development times. A maximum density of approximately 2.4 was reached in 30 seconds of color development using a fourth sample. For a color development time of 30 seconds a minimum density of 0.1 was obtained and for a development time of 4 minutes a minimum density of about 0.4 was obtained. This example illustrates that the finer grain silver halide emulsions can produce maximum dye densities according to my process using shorter color development times. However, by proper choice of development times, maximum dye densities can be achieved through the use of my process which are not dependent on silver halide grain size.

EXAMPLE 6 — THE USE OF A REDOX DYE-RELEASER

A. A photographic element having a transparent film support and a gelatino-silver halide emulsion layer coated thereon containing a redox dye-releaser was prepared. The emulsion coating contained the ingredients set forth below in Table 9.

TABLE 9

Photographic Element 6-A

Gelatino-Silver Halide Emulsion Layer: Silver Halide (10); Gelatin (200); RDR* (60)

Transparent Cellulose Triacetate Film Support

The silver halide employed was monodispersed, sulfur and gold chemically sensitized cubic grain silver bromide having a mean grain size of 0.2 micron.

*RDR

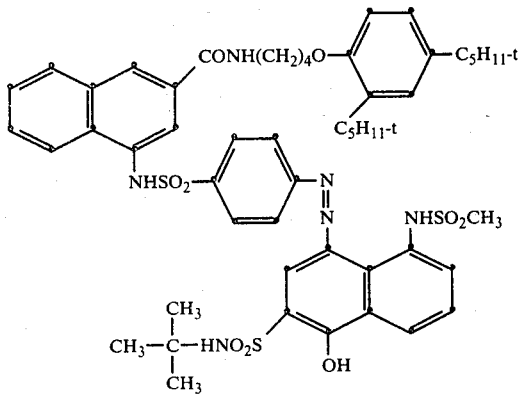

B. The photographic element was exposed with a white light source through a graduated-density test object having 21 equal density steps ranging from 0 density at Step 1 to a density of 3.0 at Step 21. The exposed element was then divided into eight (8) samples which were developed for 1 minute in a noncross-oxidizing developer of the composition set forth in Table 2, but with the substitution of 4 mg of potassium iodide per liter of developer for the potassium bromide.

C. Four of the samples were then immersed for 30 seconds, 1 minute and 2 minutes and 4 minutes, respectively, in a cross-oxidizing developer solution of the composition set forth below in Table 10.

Table 10

| Cross-Oxidizing Developer | |
|---|---|
| Potassium hydroxide | 56.0 g |
| Diaminopropanol tetraaectic acid | 2.0 g |
| 4-Hydroxymethyl-4-methyl-1-phenyl-3-pyrazolidone | 0.5 g |
| 1.4% tertiary-Butylamine borane solution | 5.5 ml |
| Water to 1 liter. | |

The samples were then immersed for 1 minute in a stop bath formed by a solution of 1 percent by weight acetic acid in water. The samples were immersed for 2 minutes in a bleachfix bath of the composition set forth in Table 11.

Table 11

| Bleach-Fix Bath | |
|---|---|
| Ammonium thiosulfate | 132.0 g |
| Sodium bisulfite | 13.0 g |
| Ammonium ferric ethylenediamine tetraacetic acid (EDTA) (0.18 M solution) | 65.6 g |
| Ethylenediamine tetraacetic acid (EDTA) | 6.56 g |
| Ammonium hydroxide (28% solution) | 27.9 g |
| Water to 1 liter, pH 6.8. | |

The samples were washed for 2 minutes in water, then immersed for 2 minutes in a solution containing 5 grams per liter of 1-hexadecylpyridinium chloride in water to shift the dye to a photographically more acceptable hue, washed for 1 minute in water and dried. The results are shown graphically in FIG. 4, wherein Curve 13 represents the shortest period in the developer solution and Curve 16 the longest period. It is apparent that insufficient silver was present in the cross-oxidizing developer solution to permit a useful dye image to be formed. That is, insufficient dye was released by the redox dye-releaser to allow a dye image to be formed by the retained redox dye-releaser remaining in the photographic element. If more silver had been present, more cross-oxidation with the redox dye-releaser would have occurred and more dye would have been released from those areas of the photographic element which were not initially exposed.

Figure 4:
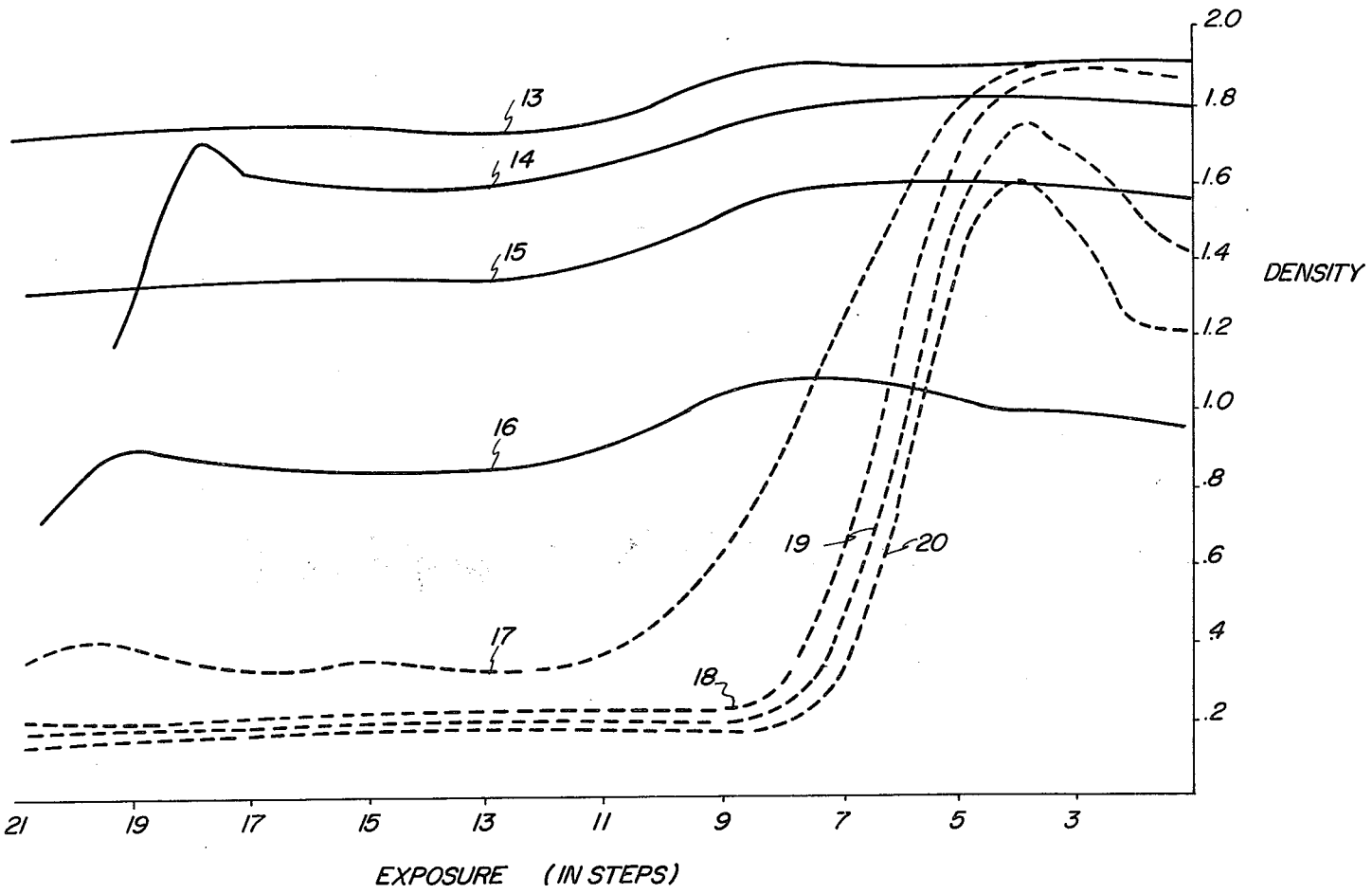

D. The procedure of Paragraph 6-C was repeated using the four remaining samples of the photographic element, except that 10 ml of 30 percent by weight hydrogen peroxide was added to the cross-oxidizing developer to convert it to a combined developer-amplification bath. A negative dye image was produced in each instance, as indicated in FIG. 4, wherein Curve 17 was produced by the sample immersed for 30 seconds in the combined developer-amplification bath; the Curve 18 was produced by the sample immersed in this bath for 1 minute; the Curve 19 was produced by the sample immersed in this bath for 2 minutes and the Curve 20 was produced by the sample immersed in this bath for 4 minutes. If the released dye had been transferred to a conventional receiver, such as a mordant layer, it is apparent that a complementary positive transferred image would have been formed.

The invention has been described with particular reference to preferred embodiments thereof but it will be understood that variations and modifications can be effected within the spirit and scope of the invention.

I claim:

1. A method of forming a dye image comprising
developing to produce a silver image in an imagewise exposed photographic element comprised of a support and at least one radiation-sensitive silver halide layer containing a developable latent image therein,
poisoning the silver image to inhibit its ability to catalyze a redox reaction between a peroxide oxidizing agent and a silver halide developing agent, wherein the peroxide oxidizing agent and the silver halide developing agent are chosen so that they are essentially inert to oxidation-reduction in the absence of a catalyst,
rendering undeveloped silver halide remaining in the radiation-sensitive layer developable,
developing the remaining silver halide to form a reversal silver image,
catalyzing with the reversal silver image a redox reaction between the peroxide oxidizing agent and the silver halide developing agent, so that oxidized silver halide developing agent is formed in an imagewise manner,
employing the oxidized silver halide developing agent to create an imagewise distribution of mobile and immobile dyes in a pattern corresponding to the reversal silver image and
transferring the mobile dye so that a dye image is formed by at least one of the immobile dye retained and the mobile dye transferred.

2. A method according to claim 1 wherein the initially developed silver image is poisoned as it is formed.

3. A method according to claim 2 wherein the initially developed silver image is formed in a developer solution and a halide ion is incorporated in the developer in a concentration sufficient to poison the initially formed silver image as a redox amplification catalyst for the reaction of the peroxide oxidizing agent and the silver halide developing agent.

4. A method according to claim 3 wherein the halide ion is a bromide ion.

5. A method according to claim 3 wherein the halide present in the first developer is bromide ion present in a concentration of from 1 to 30 grams per liter.

6. A method according to claim 5 wherein the bromide ion is present in a concentration of from 1 to 15 grams per liter.

7. A method according to claim 3 wherein the halide ion is an iodide ion.

8. A method according to claim 7 wherein the iodide ion is present in the first developer in a concentration of from 1 microgram to 1 gram per liter.

9. A method according to claim 8 wherein the iodide ion is present in the first developer in a concentration of from 1 to 10 milligrams per liter.

10. A method according to claim 1 wherein the remaining silver halide is developed using a silver halide developer containing a dye developer.

11. A method according to claim 1 wherein the photographic element contains associated with the silver halide layer a redox dye-releaser and the silver halide developing agent is a cross-oxidizing developing agent.

12. A method according to claim 1 wherein the silver halide layer is negative-working.

13. A method according to claim 12 wherein the silver halide is bromoiodide.

14. A method of forming a dye image comprising
developing to produce a silver image an imagewise exposed photographic element comprised of a support, at least one radiation-sensitive silver halide emulsion layer containing a developable latent image and, associated with the emulsion layer, an immobile redox dye-releaser as a dye-image-generating reducing agent,
poisoning the silver image to inhibit its ability to catalyze a redox reaction between a peroxide oxidizing agent and a cross-oxidizing silver halide developing agent, wherein the peroxide oxidizing agent and the developing agent are chosen so that they are essentially inert to oxidation-reduction in the absence of a catalyst,
rendering undeveloped silver halide remaining in the radiation-sensitive layer developable,
developing the remaining silver halide to form a reversal silver image,
catalyzing with the reversal silver image a redox reaction between the peroxide oxidizing agent and the cross-oxidizing silver halide developing agent to produce oxidized cross-oxidizing silver halide developing agent in an imagewise manner,
reacting the oxidized cross-oxidizing silver halide developing agent with the immobile redox dye-releaser so that a mobile dye is imagewise released and
transferring the mobile released dye so that a dye image is formed by at least one of the retained immobile redox dye-releaser and the transferred released dye.

15. A method of forming a dye image according to claim 14 wherein the initially formed silver image is developed in a noncross-oxidizing silver halide developer.

16. A method of forming a dye image according to claim 15 wherein the initially formed silver image both formed and poisoned with the noncross-oxidizing silver halide developer.

17. A method of forming a dye image according to claim 14 wherein iodide ion is employed to poison the initially formed silver image.

18. A method of forming a dye image according to claim 16 wherein iodide ion is present in the noncross-oxidizing silver halide developer in a concentration of from 1 milligram per liter to 1 gram per liter.

19. A method of forming a dye image according to claim 14 wherein a cross-oxidizing silver halide developer containing the peroxide oxidizing agent and the cross-oxidizing developing agent are brought into contact with the photographic element in performing the second developing step.

20. A method of forming a dye image according to claim 14 wherein the photographic element is washed to remove mobile dye and leave a dye image formed by the retained immobile redox dye-releaser.

* * * * *